US005634639A

United States Patent [19]

Tokito et al.

[11] Patent Number: 5,634,639

[45] Date of Patent: Jun. 3, 1997

[54] BALL GAME APPARATUS WITH A PLURALITY OF DIFFERENT BALLS AND WINNING POCKET PORTIONS

[75] Inventors: Tetsuo Tokito, Sagamihara; Shuichi Nakatome; Yasufumi Tanabe, both of Yokohama; Toshitake Inagaki, Sagamihara; Tatsuo Kawabuchi; Hiroshi Takeuchi, both of Oota-ku; Kotaro Nakano, Yokohama; Yasuo Mori, Oota-ku; Takaharu Aoki, Tama; Hideyuki Kaneko, Kawasaki; Teruyoshi Takahashi, Nakano-ku; Shinya Niwa, Kawasaki; Kiyoshi Minami, Kawasaki; Manabu Matsuo, Kawasaki, all of Japan

[73] Assignee: Namco Ltd., Tokyo, Japan

[21] Appl. No.: 412,943

[22] Filed: Mar. 29, 1995

[30] Foreign Application Priority Data

Mar. 31, 1994 [JP] Japan ..... 6-087972

[51] Int. Cl.[6] ..... A63F 7/00

[52] U.S. Cl. ..... 273/123 R; 273/123 A; 273/118 A; 273/138.3; 273/138.1; 273/139

[58] Field of Search ..... 273/108, 118 R, 273/118 A, 121 R, 121 A, 121 B, 123 R, 123 A, 124 R, 124 A, 138.1, 138.2, 138.3, 138.4, 139

[56] References Cited

U.S. PATENT DOCUMENTS

| | | | |
|---|---|---|---|
| 3,645,530 | 2/1972 | Hernandez et al. | 273/138.4 |
| 4,036,497 | 7/1977 | Garto et al. . | |
| 5,016,879 | 5/1991 | Parker et al. . | |
| 5,131,655 | 7/1992 | Ugawa | 273/121 B |

FOREIGN PATENT DOCUMENTS

| | | | |
|---|---|---|---|
| 52-35115 | 8/1977 | Japan . | |
| 53-60984 | 5/1978 | Japan . | |
| 54-14073 | 6/1979 | Japan . | |
| 5-76649 | 3/1993 | Japan | 273/121 B |
| 5-41755 | 10/1993 | Japan . | |
| 493137 | 10/1938 | United Kingdom . | |
| 2 214 909 | 9/1989 | United Kingdom . | |

*Primary Examiner*—Raleigh W. Chiu
*Attorney, Agent, or Firm*—Oliff & Berridge

[57] ABSTRACT

A ball game apparatus has a plurality of balls, a spiral rail for automatically delivering the balls, a field portion on which the balls delivered by the spiral rail can roll with a given degree of freedom, winning pocket portions and invalid pockets formed over the field portion for receiving a plurality of the balls in each of them, a CCD camera for counting the number of balls received in the winning pocket portions and a calculator for calculating a score from the number of balls counted by the CCD camera.

23 Claims, 13 Drawing Sheets

BALL GAME APPARATUS WITH A PLURALITY OF DIFFERENT BALLS AND WINNING POCKET PORTIONS

BACKGROUND OF THE INVENTION

1. Field of the Invention

The present invention relates to a game apparatus using balls.

2. Description of the Prior Art

There are known many game machines such as pinball machines, arrange-ball machines, roulette machines and so on.

The pinball machines are one that is played by an operator to put a struck pinball in any winning hole. If the pinball enters a winning hole, a predetermined number of pinballs are paid. If not so, that pinball will be withdrawn by the pinball machine. By adjusting the striking force by the operator, the initial pinball falling position can be changed to some extent.

The arrange-ball machines are one that a player hits balls toward a plurality of holes arranged into a lattice and numbered as by numerals 1 to 25, for example. When all the holes on any of the longitudinal, transverse and diagonal lines in the lattice are filled with the balls, the player becomes a winner. Also in the arrange-ball machines, the player can adjust the ball striking force to change the movement of ball to some extent.

The roulette machines are one that a player rolls a single ball on a roulette disc and stakes coins on a ball receiving recess.

With respect to a pinball machine, winning probability depends on positions of ball guide nails driven into the machine board. To know the positions of the nails providing high winning probability requires expertise. Judging the direction and force for striking a ball also requires substantial experience.

In the arrange-ball machines, similarly, the substantial experience is required for judging the direction and force for striking a ball. Moreover, there is such a problem that even if the player has last one ball, the ball becomes useless when two balls should be fallen into predetermined holes to win the game, for example. In other words, the game will finish before all the balls are used.

Since the roulette machines stake coins for only one ball, the game will finish in an instant when such a single ball enter one of the ball receiving recesses.

If a pinball enters either of the winning or void hole, the game will be finished in an instant with respect to that pinball. The arrange-ball game will be similarly finished in an instant when all the holes in a straight line are filled with balls.

SUMMARY OF THE INVENTION

The present invention provides a new and novel ball game apparatus which can be enjoyed equally by any unskilled person having no special knowledge and experience while the game is gradually proceeded with continuous pleasure until the final stage.

To this end, the present invention provides a ball game apparatus using balls to score points, comprising a plurality of balls, a ball delivery unit for automatically delivering the balls, a field portion on which delivered balls roll with a predetermined degree of freedom, at least one winning pocket portion formed over the field portion for receiving the balls, sensor means for counting the number of balls received by the winning pocket portions, and calculator means for calculating a score according to the number of balls counted by the sensor means.

Since the ball delivery unit automatically delivers balls, any player cannot adjust which direction the balls are delivered and how strong the balls are struck. Thus, the ball game apparatus can be enjoyed equally by anybody without need for knowledge and experience.

The balls may enter any of the winning packet portions after rolled on the field portion. The field portion allows the balls to roll with a predetermined degree of freedom, and the player cannot adjust the rolling motion of the balls. The entry of the balls into any winning pocket portion exclusively depends on chance irrespectively of the player's knowledge and experience.

Eventually, the player has no chance to adjust the direction and speed of rolling balls until they are delivered and moved into the winning pocket portions. Therefore, all the players can equally enjoy the game.

The ball game apparatus calculates scores depending on the number of balls entering the winning pocket portions. For example, a winning ball provides one point, two winning balls provide two points and so on. Thus, the score points increase as more balls enter the winning pocket portions.

In such a case, as a ball enter a winning pocket portion, the player will obtain one point. However, the score is still not decided. The player will watch the game with respect to whether or not the second ball further enters any of the winning pocket portions. In other words, the entry of only one ball into a winning pocket portion will not come to an end. If the second ball enter any of the winning pocket portions, one point is added. If the third ball enter any of the winning pocket portions, one point is further added. In such a manner, the game will be continued until all the balls enter any one of the pockets.

The ball game apparatus of the present invention gradually progresses the game with pleasure until the last ball enters any of the pockets.

Therefore, the game can be equally enjoyed by everybody irrespectively of their knowledge and experience. The score are progressively determined with the pleasure being continued until the last game stage.

The present invention provides a ball game apparatus further comprising a coin slot, a coin outlet and an operation unit. The operation unit is formed such that the number of bet coins can be set. The calculator means is operative for determining the number of coins to be paid back according to the number of bet coins and the score.

The interesting for the game thus increases since coins are paid back to the player depending on the game score.

In one preferred embodiment of the present invention, a plurality of said winning pocket portions are provided and said balls include particular valid balls which provide score points only when they enter particular winning pocket portions. The sensor means can identify such valid balls and count the number of valid balls received by the winning pocket portions. Therefore, the player will watch the game with respect to whether or not the particular valid balls enter the corresponding winning pocket portions, This can increase the interesting for the game with its full contents.

Alternatively, the balls may include invalid balls which cannot score any point even if they enter the winning pocket portions. The sensor means may only count the number of balls other than the invalid balls. The player will watch the game with respect to whether or not the balls other than the invalid balls enter the winning pocket portions. This can also increase the interesting for the game with its full contents.

The present invention is further characterized by that at least one invalid pocket is formed on the field portion wherein the balls make no score when the balls enter the invalid pockets.

By providing such invalid pockets in addition to the winning pocket portions, the player will watch the game while hoping that the balls enter the winning pocket portions and do not enter the invalid pockets.

The ball delivery unit may include an ejector for giving an initial speed to the balls. The winning pocket portions may be formed over a center area of the field portion which is circular funnel-shaped configuration. After the balls have been sent by the ejector to the field portion, the balls roll on the field portion and gradually fall toward the center area of the field portion. Finally, the balls may enter the winning pocket portions.

According to the present invention, the balls are delivered to the field portion by the ejector with a given initial speed. The balls then fall toward the center area of the field portion in the gradual manner. As they enter the winning pocket portions, score points will be added.

The present invention is further characterized by that the balls may be distinguishable consisting of two or more groups which can be visually distinguished from each other by the player. As the player selects one or more groups of the distinguishable balls, the sensor means counts the number of the distinguishable balls of selected groups which have entered the winning pocket portions.

According to the present invention, the balls may be distinguishable balls consisting of two or more groups which can be visually distinguished from each other, and the player selects one or more groups of the distinguishable balls. When the distinguishable balls of selected groups enter the winning pocket portions, given points are scored, but when the distinguishable balls of non-selected groups enter the winning pocket portions, no points are scored.

Thus, the player will watch the game with respect to whether or not his or her selected distinguishable balls enter any of the winning pocket portions. This can further increase the interesting for the game with its full contents.

The present invention is further characterized by that a plurality of the winning pocket portions are formed and that the player can select one of the winning pocket portions. As the balls enter a selected winning pocket portion, given points are scored.

According to the present invention, the player can select one of the winning pocket portions. As the balls enter a selected winning pocket portion, given points are scored. Even if the balls enter a non-selected winning pocket portion, no point is added to the score.

The player will watch the game with respect to whether or not a ball enters the selected winning pocket portion. This can further increase the interesting for the game with its full contents.

The present invention is further characterized by that said ball delivery unit includes a guide rail which spirally extends in a vertical direction and that said winning pocket portions are formed over a center area of the field portion which is of circular funnel-shaped configuration. After the balls roll downwardly on the guide rail while being accelerated, it is delivered to the field portion. The balls then roll on the field portion in the circumferential direction and gradually fall toward the central area of the field portion. Finally, the balls may enter the winning pocket portion.

According to the present invention, the balls has roll downwardly on the guide rail while being accelerated, and are delivered to the field portion at a given speed in such a manner that it will roll on the field portion in the circumferential direction.

Since the field portion is of funnel-shaped configuration, it is inclined downwardly from the outer periphery to the center. Therefore, the balls will gradually fall toward the center area of the field portion while rolling in the circumferential direction.

The winning pocket portions are formed over a center area of the field portion, and given points are scored when the balls enter the winning pocket portions.

During such a process, the balls will roll on the guide rail spirally and on the field portion circumferentially. This means that the ball can roll and move usefully in a given space for a prolonged time period.

This requires a given time period until all the balls enter the pockets after they have been delivered. Thus, the player can enjoy the game for the given time period.

The present invention is further characterized by a plurality of said operation units through which a plurality of players can simultaneously enjoy a game.

Since a plurality of players can simultaneously enjoy a game through a plurality of operation units, the players can compete with one another for the number of coins.

The present invention is further characterized by a plurality of winning pocket portions each of which is previously determined to correspond to one of the operation units. Each of the players selects one of the winning pocket portions by selecting one of the operation units. When the balls enter a selected winning pocket portion, given points are scored.

Since winning pocket portion are previously determined to correspond to the operation unit respectively, the latter can set the number of bet coins to be paid back if the balls enter the corresponding winning pocket portion. As a player select one of the operation units, the winning pocket portion corresponding to the selected operation unit is automatically selected. Thus, each of the players can select any one of the winning pocket portions.

If a ball enter a selected winning pocket portion, given points are added to the score. If not so, no point is added.

Therefore, the players will watch the game with respect to whether or not their balls enter the respective selected winning pocket portions. This can further increase the interesting for the game with its full contents.

The present invention is further characterized by that a plurality of the operation units may be disposed around the field portion so that all the players can operate their operation units while facing the field portion. The guide rail may be formed such that at least a part of entire shape of the balls can be seen from the direction of the operation units while the balls are guided on the guide rail. The selected winning pocket portions may be arranged exposed to the corresponding operation unit. Thus, the players can observe the balls as they spirally roll on the guide rail, are delivered to the field portion and enter the selected winning pocket portions.

Since a plurality of the operation units are disposed around the field portion so that all the players can operate their operation units while facing the field portion, a plurality of the players located around the field portion can enjoy the same game at the same time.

Since each ball is guided by the guide rail while exposing at least part of the ball, the players can observe the rolling balls. Since the guide rail is spiral, the players will view the balls rolling along the spiral path. This provides a visually interesting impression which can also make the game further interesting.

Since the winning pocket portions are also disposed exposed, the players can view a moment when the balls enter the winning pocket portions. Since the ball game apparatus is formed so that the score depends on the number of balls entered the winning pocket portions as described, the players can see the balls enter the winning pocket portions and that can increase the excitement of the game.

The present invention is further characterized by that it comprises ball lifting means for lifting and conveying the balls from a position lower than the field portion to the top of the guide rail and an introduction rail for introducing the balls into the ball lifting means. The winning pocket portions are formed to hold the balls on the field portion. The field portion includes a collection opening formed therein at a position nearer the center of the field portion than the winning pocket portions. The winning pocket portions and field portion are movable relative to each other to release the balls from the winning pocket portions. The collection opening is connected to the ball lifting means through the introduction rail such that the balls can be introduced into the ball lifting means. When the balls are released through a relative movement between the winning pocket portions and the field portion, the balls roll on the field portion and fall onto the introduction rail through the collection opening. The balls then move into the ball lifting means and are lifted to the top of the guide rail. The balls spirally roll on the guide rail and fall onto the field portion.

According to the present invention, the ball will be circulated as follows: First of all, the balls are lifted from a position lower than the field portion to the top of the guide rail by the ball lifting means. The balls spirally roll and fall toward the field portion while being guided by the guide rail. After delivered to the field portion, the balls gradually fall to the center of the field portion while rolling on the field portion in the circumferential direction.

The falling balls are then received and held by the winning pocket portions which are formed over the center area of the field portion. When the balls are released from the winning pocket portions through the relative movement between the winning pocket portions and the field portion, the balls fall along the inner funnel-shaped wall of the field portion. Finally, the balls are collected through the collection opening that is formed in the field portion in the vicinity thereof.

Since the collection opening is connected to the ball lifting means through the introduction rail, the collected balls are introduced into the ball lifting means and again lifted to the top of the guide rail.

The present invention is further characterized by ball storing means for temporarily storing the balls collected from the field portion and for delivering stored balls to the ball delivery unit after a predetermined time period.

In such an arrangement, the balls may be stored and held in the ball storing means, for example, in a time when coins are thrown to set the number of bet coins. Thereafter, the balls may be released and delivered to the ball lifting means.

The present invention is further characterized by that the balls are distinguishable balls consisting of two or more groups which can be visually distinguished from each other by the player and that the ball storing means includes distinguishing means for distinguishing the distinguishable balls, sorting means for sorting the distinguishable balls, and number setting means for setting the number of distinguishable balls to be used for each group in the game. According to the number of distinguishable balls set by the number setting means, the ball storing means delivers stored balls into the ball delivery unit while sorting them into different groups.

According to the present invention, distinguishable balls may be sorted and stored in every groups by the distinguishing and sorting means. The number setting means can set a predetermined number of distinguishable balls in every group.

Thus, a game can be varied by changing the number of distinguishable balls in every group.

In one preferred embodiment of the present invention, by changing points to be given when the distinguishable balls enter the winning pocket portions in every group, and by changing the number of distinguishable balls in every group the game may be improved in interest since the probability in the entry of balls into the winning pocket portions are different for every group.

For example, when the total number of blue, red and yellow balls used is equal to 15 and if five balls are used for every color, the probability in the entry of balls into the winning pocket portions for every color is equal. If six blue balls, five red balls and four yellow balls are used, the probability sequentially decreases in the order of blue, red and yellow as described.

In another preferred embodiment of the present invention, the number setting means may automatically set the number of balls for each group at random. In such a case, the ratio of balls between different groups cannot be controlled by the player. This increases the interest in the betting game. It is further preferred that the player is previously informed of the ratio of balls set at random.

The present invention is further characterized by that the winning pocket portions include a plurality of pockets which respectively receive a plurality of the distinguishable balls and have a configuration such that the player can tell the number of received distinguishable balls in each of the pockets. The sensor means may count the number of the received distinguishable balls in each of the pockets while the calculation means may calculate and score points from the number of the received distinguishable balls according to a predetermined rule.

According to the present invention, the score points are calculated and added from the number of distinguishable balls received by each of the pockets according to the predetermined rule. Assuming that three pockets each capable of holding two balls are provided to a winning pocket portion, a rule that should be one point added at each time when one ball enters each of the pockets or a rule that one point should be added when two balls enter one pocket and no ball enter the other pockets can be applied, for example.

Moreover, since a rule that points to be added are determined according to the total number of balls received by one winning pocket portion can be also applied, the ball game apparatus may be played according to at least two rules. This can further increase the interesting in the game.

The present invention is further characterized by that the winning pocket portions are formed to have a configuration such that the player can tell a group of the received distinguishable balls in each of the pockets. The sensor means distinguishes a group of the received distinguishable balls from each other in each of the pockets. The calculation means calculates and scores points from the number and group of the received distinguishable balls according to a predetermined rule.

According to the present invention, the score points can be calculated and added from the number and group of the distinguishable balls entered each of the pockets according to a predetermined rule.

In a further preferred embodiment of the present invention, the balls may be colored with red, blue or yellow. At the same time, a winning pocket portion may include three pockets each capable of holding two balls. In such an arrangement, given points may be scored when two red balls enter the first pocket portion, or when two blue balls enter the second pocket portion, or when two yellow balls enter the third pocket portion.

DETAILED DESCRIPTION OF THE PREFERRED EMBODIMENTS

The present invention will now be described by way of example with reference to the drawings.

Figure 1:
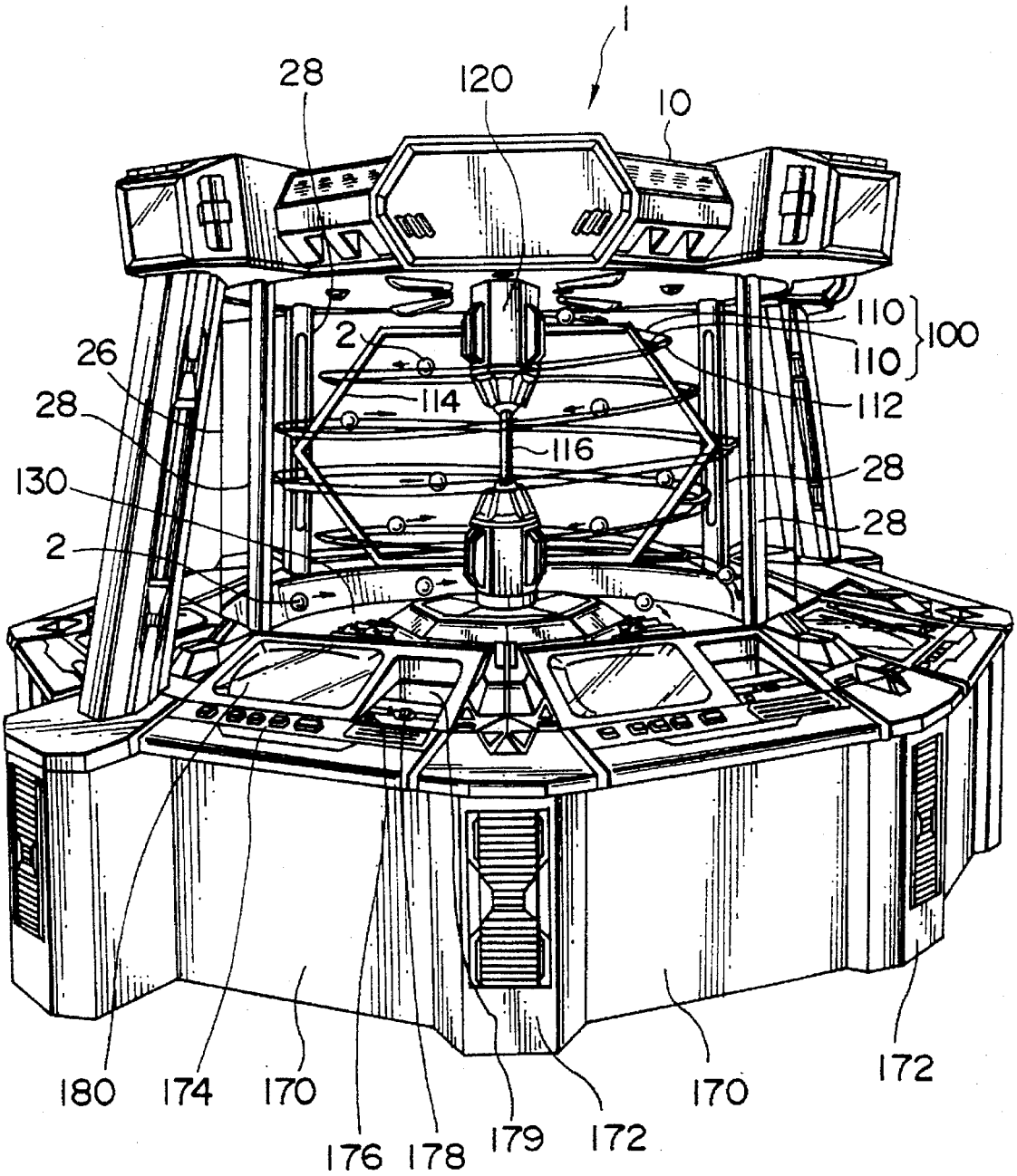
FIG. 1 is a perspective view of the entire layout of a ball game apparatus constructed in accordance with the present invention.

FIG. 1 is a perspective view of the outline of a ball game apparatus constructed in accordance with the present invention. The ball game apparatus comprises a machine body 1 including a decorated housing 10, a spiral rail 100 functioning as a ball delivering portion, a field portion 130 for rolling balls at random, winning pocket portions 140 and invalid pockets 150 (see FIG. 10), balls 2 colored separately with four colors and a plurality of play stations 170 disposed around the machine body 1, each of the play stations 170 having an operation unit.

First, a brief description of the flow of the balls 2 will be given. The balls 2 are stored in a storage rail 70. The necessary number of balls 2 are then fed into a guide rail 30*c* by a feeding disc 40 and moved from the guide rail 30*c* to a conveyer 90. The conveyer 90 upwardly moves the balls 2 which are then fed into the spiral rail 100 through a guide rail 30*d*, guide pipe 24 and delivery pipe 122.

Players compete for score points which depend on the number of balls rolling from the spiral rail 100 into the player's winning pocket portions 140 via the field portion 130.

On termination of the game, the balls 2 are fed out from the winning pocket portions 140 into a spiral collection rail 160. The balls 2 are again moved to the storage rail 70 through guide rods 22 via the guide rail 30*a*.

(Machine Body 1)

Figure 2:
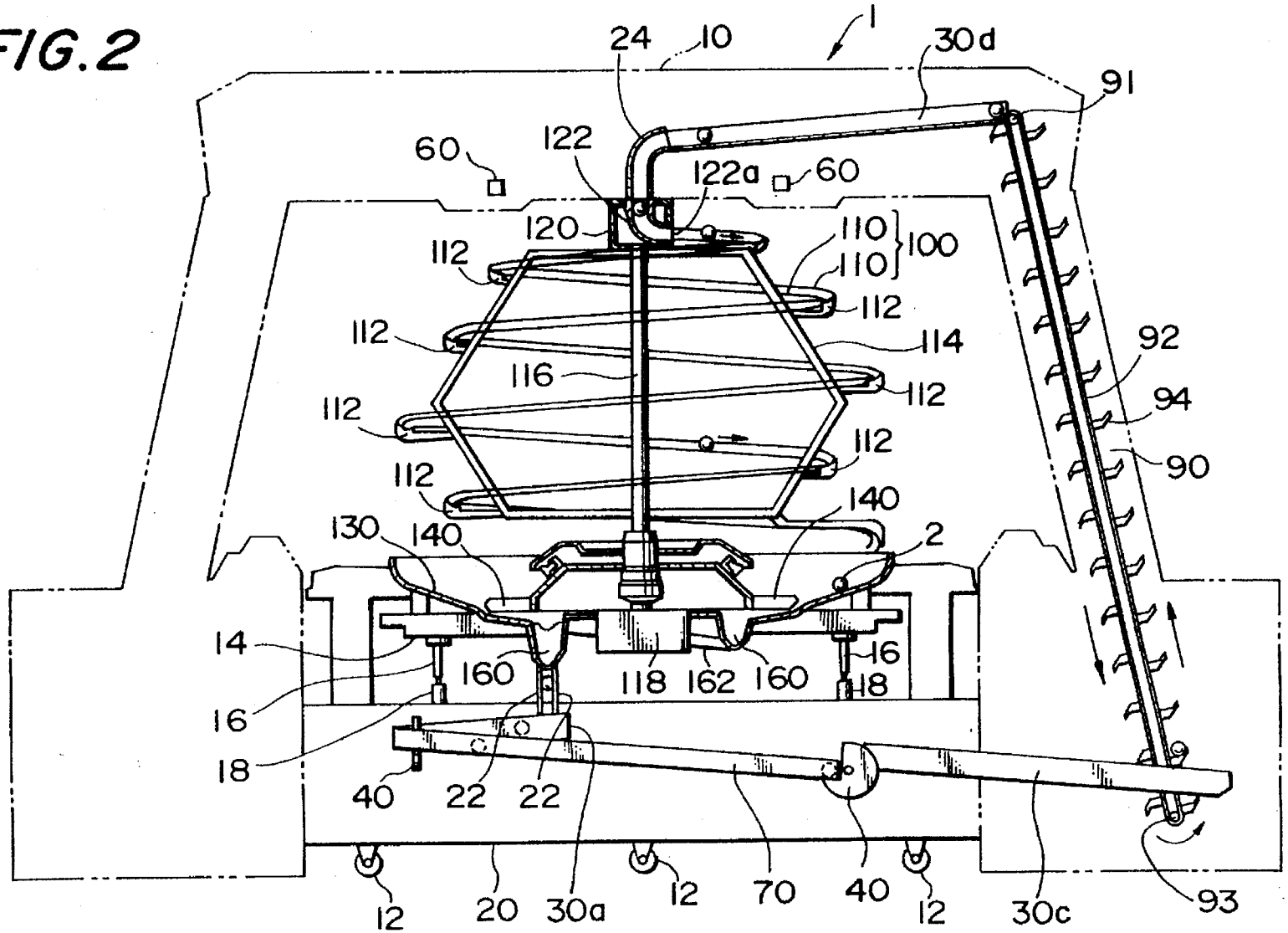
FIG. 2 is a side view with a part of sectional view of the primary parts of the apparatus, with the housing being shown by imaginary line (two-dot chain line).

Referring to FIG. 2, there is shown a side view with a part of sectional view of the primary parts of the machine body 1, with the housing 10 being shown by imaginary line (two-dot chain line).

As shown in FIG. 2, the machine body 1 comprises a machine base 20 which includes a plurality of casters 12 on the underside thereof. The machine base 20 supports the field portion 130.

More particularly, the field portion 130 is mounted on a support plate 14 which includes support shafts 16 with a male screw extending vertically from the underside of the support plate 14. Each of the support shafts 16 is screwed in the corresponding one of bearings 18 with a female screw which are formed on top of the machine base 20.

The support shafts 16 and bearings 18 are of hexagonal cross-section that can be received in manipulating tools such as wrenches to rotate and/or lock them. When one of the support shaft 16 or bearing 18 is locked against rotation. The other member can be rotated to regulate the height of the support plate 14.

If three sets of support shaft 16 and bearing 18 are located at three points corresponding to the vertexes of a substantial equilateral triangle, the field portion 130 can be leveled while being supported.

As shown in FIG. 1, a transparent cylinder 26 extending in the vertical direction is located around the outer periphery of the field portion 130 to shield the field portion 130 from the exterior. Such a transparent cylinder 26 can avoid an interference due to wind and/or manual injustice while preventing dirts and dusts from entering the field portion 130. The transparent cylinder 26 are supported and reinforced by support posts 28 which are located adjacent the outer periphery of the field portion 130.

(Machine Base 20)

To collect and convey the balls 2 rolling on the field portion 130, the interior of the machine base 20 contains the guide rods 22, the guide rails 30*a*, 30*b*, 30*c* and 30*d*, the feeding disc 40, a CCD camera 50 together with a calculating unit functioning as distinguishing means; the storage rail 70 functioning as storage means, a storage door 80 together with a coil spring 84 and a solenoid 86 functioning as sorting means.

These components will further be described with reference to FIG. 3 which is a schematic plan view illustrating the collection and conveyance of the balls 2.

Figure 3:
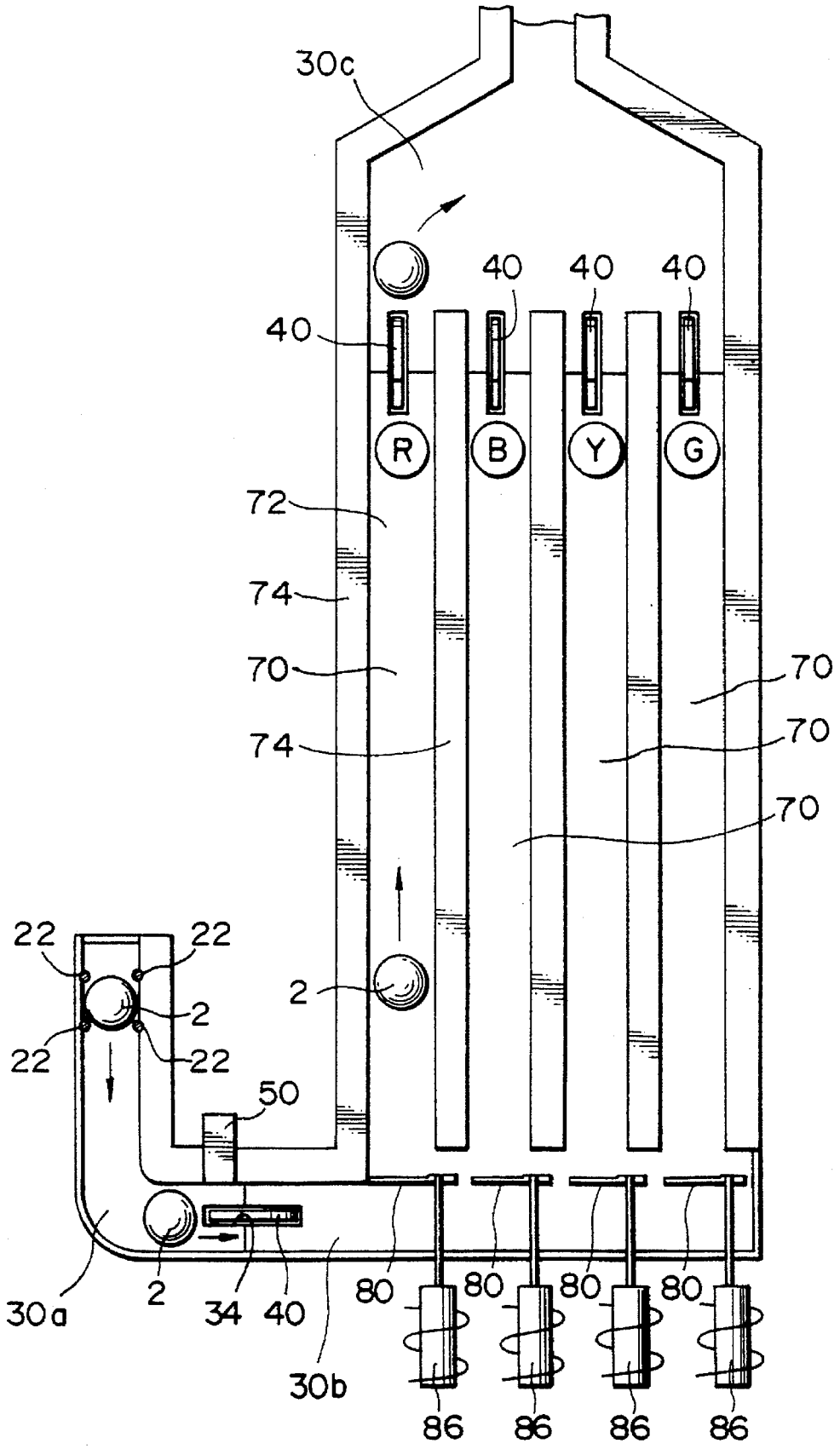
FIG. 3 is a schematic plan view of ball collecting and conveying means.

Referring to FIGS. 2 and 3, there are shown guide rods 22 for guiding the balls 2 from the field portion 130. FIG. 2 shows the back view of the guide rods 22 while FIG. 3 shows the cross-section of the guide rods 22. In the illustrated embodiment, four guide rods 22 are located to be brought into contact with the outer periphery of each ball 2 at four points. Thus, the balls 2 will be guided to move within the space formed by the four guide rods 22. Such guide rods 22 can simply steer the balls 2 to provide a desired guidance at a desired location. Since the balls 2 are externally exposed, the maintenance becomes easy.

(Guide Rail 30)

Figure 4A:
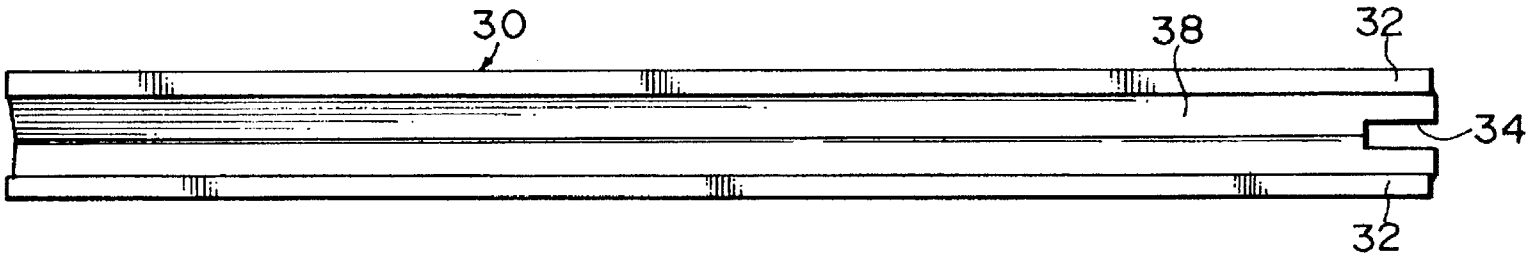
FIGS. 4A to 4C illustrate an introduction rail.
Figure 4B:
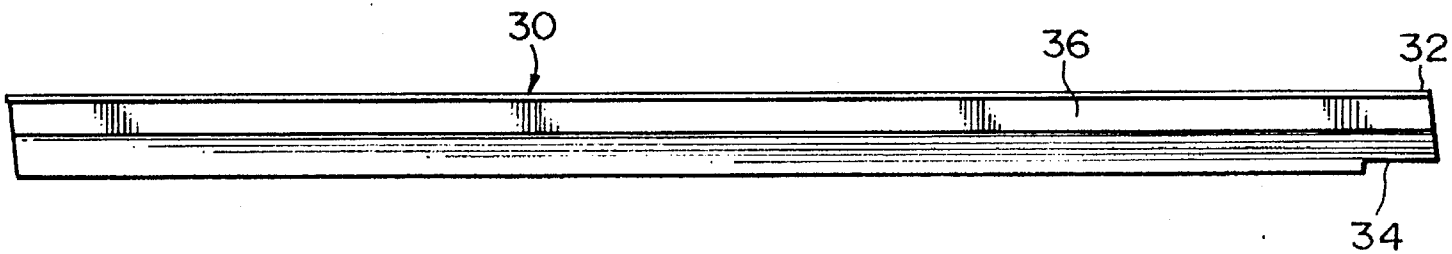
Figure 4C:
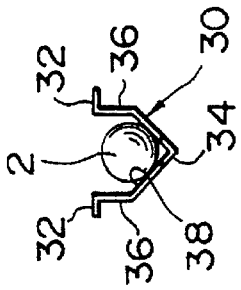

The balls 2 are thus delivered to the guide rail 30*a* through the-guide rods 22. FIGS. 4A to 4C show a guide rail 30 which is the straightened guide rail 30*a*. FIG. 4A is a plan view; FIG. 4B a side view; and FIG. 4C a front view.

As shown in FIG. 4C, the guide rail 30 includes a bottom wall portion 38 of substantially V-shaped cross-section and upright side wall portions 36 upwardly extending from the bottom wall 38 at the opposite side edges thereof. The balls 2 rolling on the guide rail 30 will be supported by the bottom and side walls 36, 38 of the guide rail 30. There is a gap between the lowermost V-shaped bottom of the bottom wall 36 and the balls 2. Thus, the balls 2 will not jam in the guide rail 30 even if dirts and dusts are accumulated therein. The guide rail 30 also includes flanges 32 extending outwardly from the top edges of the side wall portions 36. The flanges 32 is intended to reinforce the guide rail 30 and may be used to mount the guide rail 30 on the machine body through screws or the like, if necessary.

As shown in FIGS. 4A and 4B, the guide rail 30 is formed with a notch 34 in the bottom wall 38 at one end. The notch 34 has a length longer than the radius of a ball 2, but slightly shorter than the diameter of the same. As shown in FIG. 3, the notch 34 receives part of a feeding disc 40 for lifting and feeding the balls 2 to a raised position.

(Feeding disc 40)

Figure 5A:
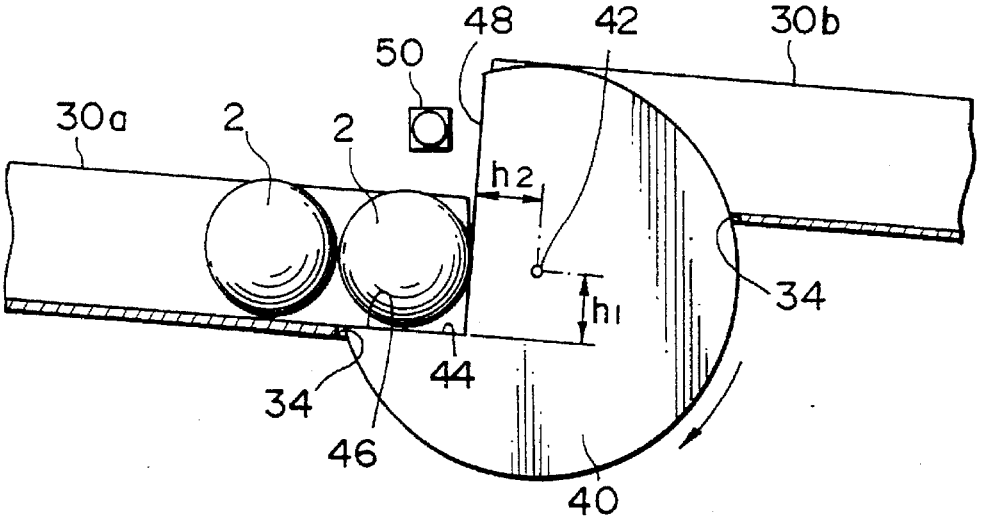
FIGS. 5A to 5C illustrate a feeding disc for lifting and feeding balls to a raised position.
Figure 5B:
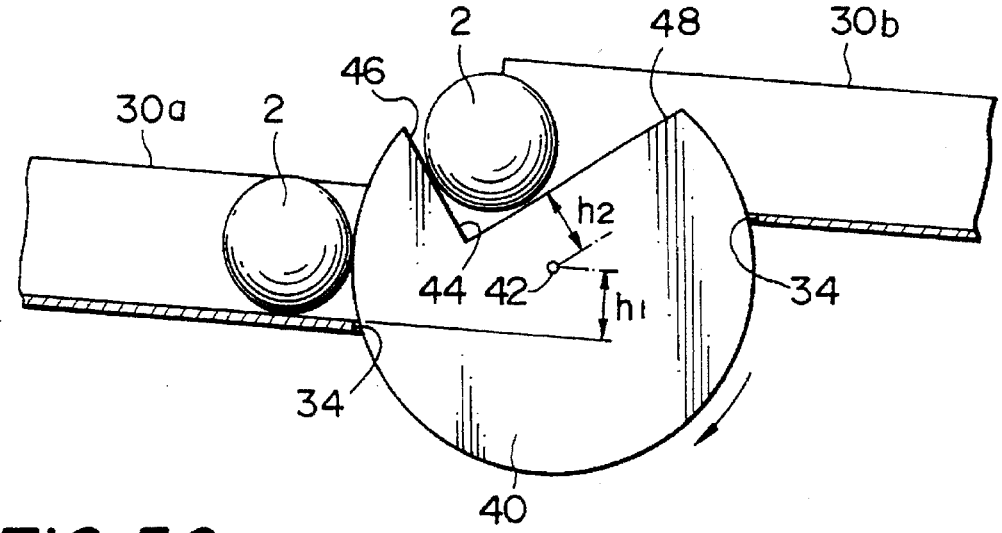
Figure 5C:
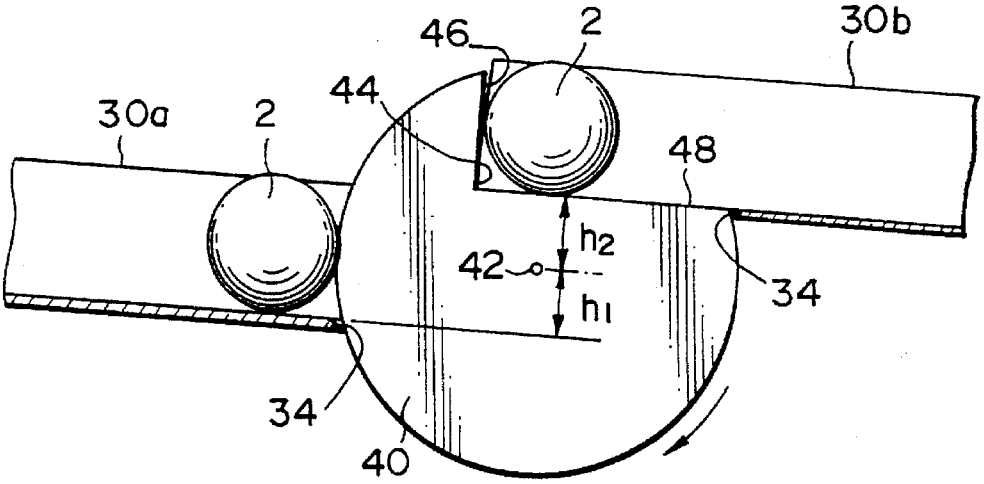

The arrangement and function of the feeding disc 40 for lifting and feeding the balls 2 to a raised position is shown in FIGS. 5A to 5C which show longitudinal sections of the guide rails 30*a*, 30*b*.

In FIGS. 5A to 5C, the guide rails 30*b* is located higher than the guide rail 30*a*. The lower guide rail 30*a* gradually declines toward the feeding disc 40. The balls 2 will roll on the declined guide rail 30*a* toward the feeding disc 40. The notch 34 in the guide rail 30*a* receives part of the feeding disc 40. The higher guide rail 30*b* is disposed substantially in alignment with the lower guide rail 30*a*. The notch 34 of the higher guide rail 30*b* also receives part of the feeding disc 40. The higher guide rail 30*b* is also gradually declines as it moves away from the feeding disc 40. The balls 2 will roll on the higher guide rail 30*b* away from the feeding disc 40.

The feeding disc 40 is mounted and rotates circumferentially around a pivot shaft 42 and has a sector-shaped notch 44 formed therein. As shown in FIG. 5A, the sector-shaped notch 44 includes a first notch side 46 for contacting the bottom of the balls 2 rolling on the lower guide rail 30*a* and a second notch side 48 for contacting the bottom of the balls 2 rolling on the higher guide rail 30*b*. An angle included between the first and second notch sides 46, 48 is equal to about 90 degrees. It is required that the first and second notch sides 46, 48 are larger than at least the radius of a ball 2. Preferably, the first and second notch sides 46, 48 are substantially equal to or larger than the diameter of the ball 2. Thus, the balls 2 can be stably placed one at a time on the first and second notch sides 46, 48.

As shown in FIG. 5A, the first notch side 46 is formed in the feeding disc 40 at a position lower than the center thereof by a distance h1 while the second notch side 48 is formed in the feeding disc 40 at a position spaced away from the center thereof toward the outer end of the first notch side 46 by a distance h2. As shown in FIG. 50, the total distance, h1+h2 is a distance through which each ball 2 is to be lifted and fed.

The function of the feeding disc 40 for lifting and feeding the balls 2 will be described. As shown in FIG. 5B or 5C, a ball 2 rolled on the lower guide rail 30*a* is first engaged and stopped by the outer periphery of the feeding disc 40. As the feeding disc is rotated clockwise and when the sector-shaped notch 44 thereof is directed to the ball 2, the latter moves into the sector-shaped notch 44. As the feeding disc 40 is further rotated, the bottom and side of the ball 2 will be supported by the first and second notch sides 46, 48, respectively, as shown in FIG. 5A.

As the feeding disc 40 is further rotated, the ball 2 will be supported at the sides thereof by the first and second notch sides 46, 48, as shown in FIG. 5B. As the feeding disc 40 is still further rotated, the bottom and side of the ball 2 will be supported by the second and first notch sides 48, 46, respectively, as shown in FIG. 5C. Thus, the feeding of the ball 2 will be completed. As the feeding disc 40 is still further rotated, the first notch side 46 will push the ball 2 at the side thereof toward the higher guide rail 30*b*. The ball 2 will roll on the higher guide rail 30*b* along the inclination away from the feeding disc 40. In such a manner, the balls 2 are conveyed.

Since the total distance, h1+h2, is the distance through which ball 2 is to be fed, this distance will increase as the respective one of the distances h1 and h2 is larger. Since the length of the first or second notch side 46, 48 decreases as the distances h1 or h2 increases, however, the distances h1 and h2 must be increased within a range in which the length of the first or second notch side 46, 48 is larger than at least the radius of the ball 2, as described.

As shown in FIG. 3, thus, the balls 2 are guided and conducted onto the lower guide rail 30*a* by the guide rods 22 and then onto the higher guide rail 30*b* by the feeding disc 40.

In this embodiment, balls 2 of four different colors are used. Each of the colored balls 2 may be distinguished when it is lifted and fed by the corresponding one of the feeding discs 40. More particularly, as shown in FIGS. 3 and 5A, the color of a ball 2 lifted and fed by the feeding disc 40 can be sensed and distinguished by the CCD camera 50 and distinguishing and calculation unit (not shown) which define distinguishing means.

More particularly, the balls 2 lifted and fed by the feeding disc 40 is sensed by the CCD camera 50, the resulting image information being then input into the distinguishing and calculation unit (not shown). The distinguishing and calculation unit determines the color component data of the sensed image from the image information. The color component data is then used to determine the color information of the ball.

More particularly, the distinguishing and calculation unit comprises an RGB decoder (not shown), an A/D converter, a frame buffer and a processing unit. The image information is input from the CCD camera 50 into the RGB decoder which in turn converts the image information into RGB data according to a given converting process. The converted RGB data is then converted into digital data for R, G and B by the A/D converter. The digital data for R, G and B are stored in the frame buffer at R, G and B memories, respectively. The stored RGB data will be read out and used to determine the colors of the balls 2 by the processing unit.

If the distinguishing and calculation unit determines the color information from the ratio of colors in the color component data, rather than the absolute values of the color component data, any influence due to the external right or the like can be reduced.

Thus, the colors of the balls 2 are distinguished as they are fed by the feeding discs 40. When the balls 2 are conducted onto the higher guide rail 30*b*, the distinguishing between colors has been completed, the colors of the balls 2 are known. Therefore, the balls 2 are sorted and stored separately for every color. The desired number of balls 2 for each color can be taken out.

To store the colored balls 2 separately for every color, this embodiment uses four storage rails 70 and sorting means which is formed by solenoids 86, coil springs 84 and storage doors 80.

(Storage Rails 70)

As shown in FIG. 3, four storage rails 70 are connected to guide rails 30*b* at right angle. Four different colored balls 2 can be stored in the respective storage rails 70. A storage door 80 separates one of the guide rails 30*b* from the corresponding storage rail 70. As the storage door 80 is opened and closed through the corresponding set of solenoid 86 and coil spring 84, balls 2 having a color will enter the corresponding storage rail 70.

Each of the storage rails 70 includes a bottom wall portion 72 and side wall portions 74 located on the opposite sides of the bottom wall portion 72. For example, if balls 2 of four, red, blue, yellow and gold colors are used, the four storage rails 70 will store the balls 2 in the order of red, blue, yellow and gold as viewed from the left in FIG. 3.

Figure 6:
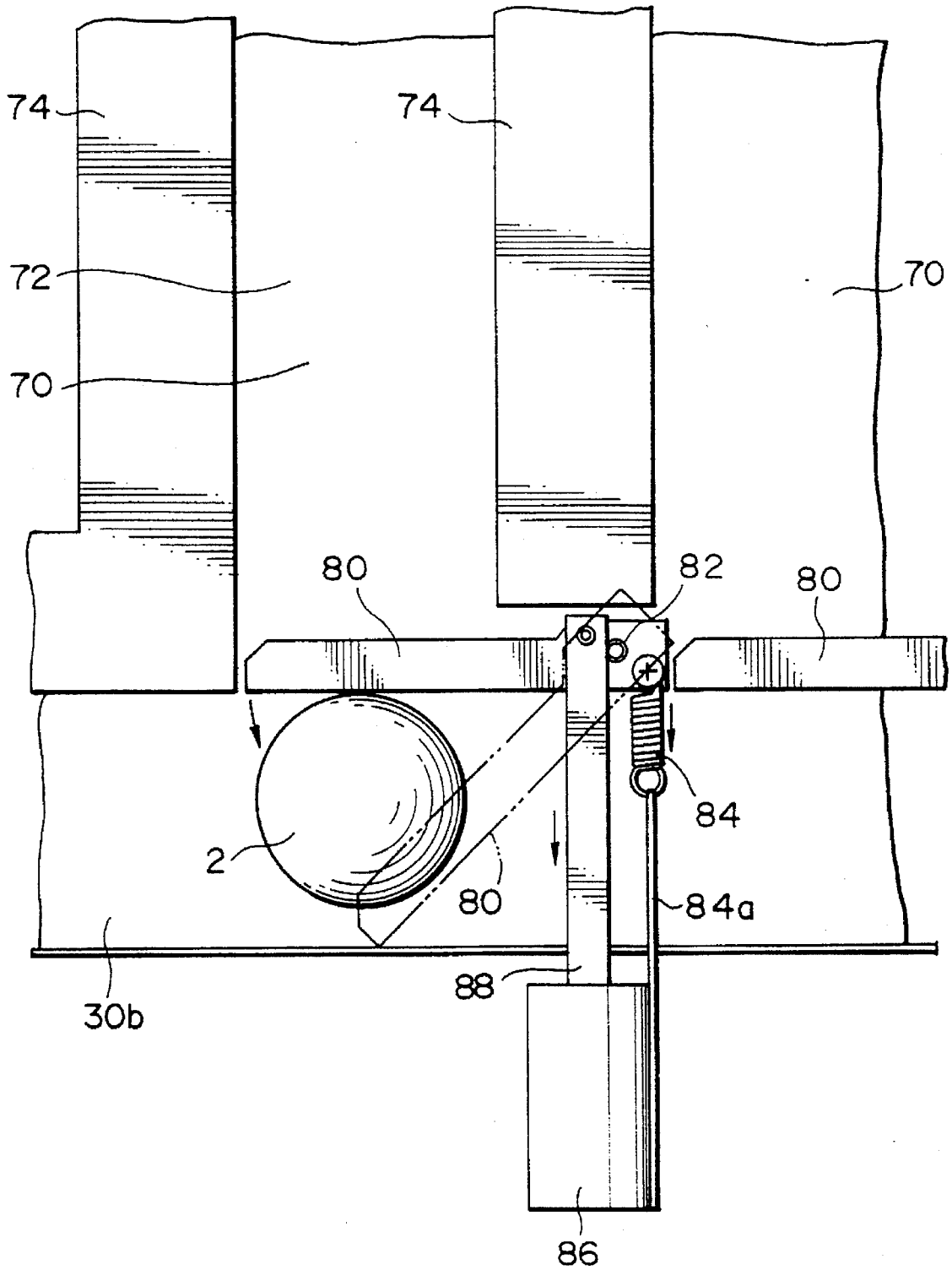
FIG. 6 is a plan view showing the details of a mechanism for opening and closing a storage door.

The details of the mechanism for opening and closing the storage doors 80 are shown in FIG. 6 which is an enlarged plan view illustrating the storage doors 80 and associated parts in FIG. 3.

In FIG. 6, each of the storage doors 80 is in the form of a plate like-member having the same height as that of the side walls 74 in the storage rail 70 or a rod-like member having a size sufficient to prevent the balls 2 from rolling into the storage rail 70. The storage door 80 is disposed at a position closing the entry of the storage rail 70. The storage door 80 is pivotally supported about a pin 82 adjacent the downstream side of the guide rail 30*b* in the direction of movement of the balls 2. As the storage door 80 is rotated around the pin 82, it can prevent of a ball 2 from rolling straight on the guide rail 30*b* as shown by imaginary line (two-dot chain line) in FIG. 6, and at the same time open the entry of the storage rail 70 to introduce the balls 2 thereinto, In order to smoothly convey balls 2, it is preferred that the guide and storage rails 30*a*, 70 are declined along the movement of the balls 2.

To open and close each storage door 80, a corresponding set of solenoid 86 and coil spring 84 are used. The solenoid 86 includes a movable core 88 having an extension. The tip of such an extension is pivotally mounted on the top surface of the storage door 80. More particularly, the solenoid 86 is located at a position slightly spaced away from the pin 82 such that the movable core 88 is pulled in the same direction as when the storage door 80 is opened (shown by arrow in FIG. 6).

Further describing the details with reference to FIG. 6, the movable core 88 is biased to a retracted position (shown by arrow in FIG. 6) in the same direction as when the storage door 80 is opened (shown by arrow in FIG. 6). For such a purpose, the solenoid 86 is disposed at a position opposite to the storage rail 70, as shown in FIG. 6.

Therefore, no force acts on the storage door 80 to close it. To close the storage door 80, another suitable means is required. In this embodiment, the coil spring 84 is used as another suitable means. Namely, the coil spring 84 is located to bias the storage door 80 to a closed position.

One end of the coil spring 84 is mounted on the top surface of the storage door 80 at a position that is symmetrical to the mounting position of the movable core 88 about the pin 82, as shown in FIG. 6. The other end of the coil spring 84 is mounted on a wire 84*a* at the side opposite to the storage rail 70. Thus, the tension of the coil spring 84 will act to close the storage door 80, as shown in FIG. 6.

In such a manner, the solenoid 86 exerts a force on the storage door 80 to open it while the coil spring 84 applies a force on the storage door 80 to close it. As the solenoid 86 is energized, thereinto, the storage door 80 is opened. When the solenoid 86 is de-energized, the storage door 80 is closed under the action of the coil spring 84.

In such an arrangement, the color of a ball 2 lifted and fed from the guide rail 30*a* to the guide rail 30*b* is first sensed by the distinguishing and calculation unit (not shown) through the CCD camera 50. The distinguishing and calculation unit previously stores in which storage rail 70 the balls 2 having a color should be received, that is, the storage door 80 of which storage rail 70 is to be opened.

After the color of a ball 2 has been sensed, the distinguishing and calculation unit specifies the storage door 80 of the storage rail 70 corresponding to the color of the sensed ball 2 and feeds a command to a drive to energize the solenoid 86 for the specified storage door 80.

Thus, the drive will energize the solenoid 86 to open the storage door 80. The opened storage door 80 will prevent the ball 2 from rolling along the guide rail 30*b*, as shown by imaginary line in FIG. 6. Therefore, the ball 2 turns toward and moves into the corresponding storage door 70.

In this embodiment, the game may be played by specifying the number of balls 2 for every color. As described, the feeding discs 40 are provided for delivering the balls from the respective one of the storage rails 70.

As shown in FIG. 2, each of the storage rails 70 is mounted so that it gradually declines toward the entry, A feeding disc 40 is disposed at the lowermost end of the storage rail 70. As will be apparent from FIG. 3, the rotation of the respective feeding disc 40 feeds the balls 2 of the desired color. The arrangement and function of the feeding discs 40 have been described hereinbefore.

Since each of the feeding discs 40 lifts and feeds the balls 2 one at a time, the number of balls 2 depends on the revolution of the feeding disc 40.

When a ball 2 enters the sector-shaped notch 44 of the corresponding feeding disc 40 as shown in FIG. 2, the ball 2 begins to be lifted and fed by the feeding disc 40. The next ball 2 waits until the feeding disc 40 makes one revolution with the sector-shaped notch 44. A ball 2 will be fed by the feeding disc 40 through one revolution. If the number of rotation of the feeding disc 40 is determined, therefore, the number of balls 2 to be fed by the feeding disc 40 through the number of rotation thereof will be determined. If a number setting means is used to set the number of rotation of the feeding disc 40, the different number of balls 2 for every color can be delivered in the game.

If the balls 2 used are of red, blue, yellow and bold colors as described with reference to FIG. 3 and when balls 2 are to be delivered in such color arrangements as three red ones, eight blue ones, five yellow ones and a gold one through one game stage, the four feeding discs 40 may be rotated three times, eight times, five times and one time in the order starting from the leftwardmost. Thus, the desired number of balls 2 for each color can be delivered. The starting position of the revolution in the feeding disc 40 is preferably at a position where a ball 2 enters the sector-shaped notch 44 thereof.

Furthermore, for example, when the gold ball 2 is to be a bonus ball and to be delivered it after all the other balls have been delivered, the corresponding feeding disc 40 may be rotated after all the other feeding discs 40 have been rotated. In such a manner, this embodiment using the feeding discs 40 can simply set not only the number of balls 2 to be delivered for each color, but also the timing at which the balls 2 for each color are to be delivered.

As shown in FIG. 2, the delivered balls 2 are moved on the guide rail 30*c* toward a conveyor 90 which functions as ball lifting means. Such a conveyor 90 is disclosed in Japanese Utility Model Application No. 51-142599 (Japanese Utility-Model Laid-Open No. 53-60984).

(Conveyor 90)

Figure 7A:
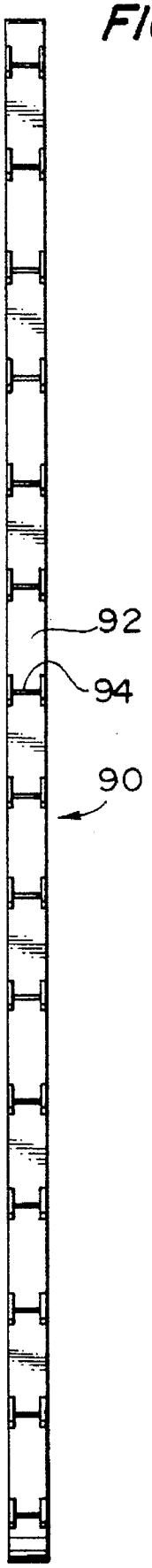
FIGS. 7A to 7C illustrate a conveyor.
Figure 7B:
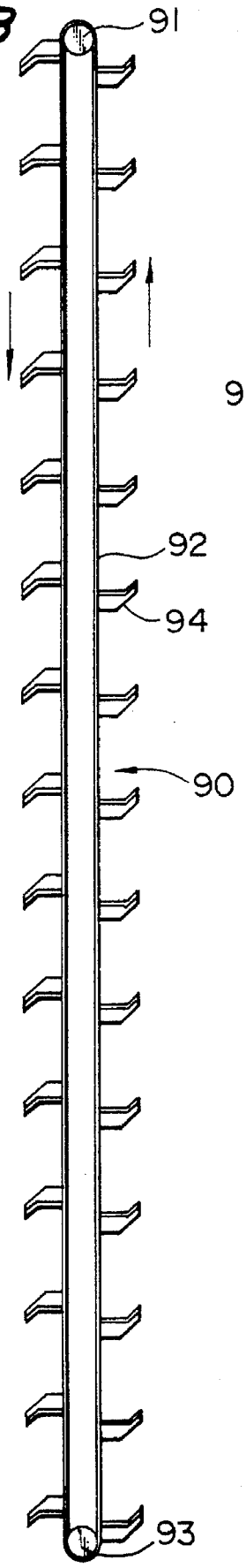
Figure 7C:
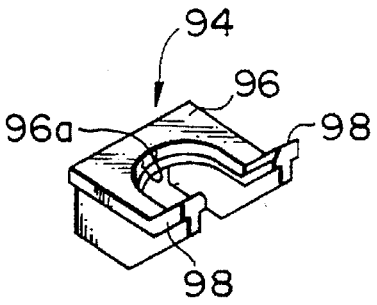

Such a conveyor 90 usable in this embodiment is shown in FIGS. 7A to 7C. FIG. 7A is a front view; FIG. 7B a side view; and FIG. 7C a perspective view of a ball support.

The conveyor 90 comprises a conveyor belt 92 and ball supports 94. The conveyor belt 92 is in the form of in endless belt for upwardly moving balls 2 from the guide rail 30*c* and which is spanned between an upper pulley 91 and a lower pulley 93. The outwardly facing side of the endless conveyor belt 92 is formed with ball supports 94.

As shown in FIG. 7C, each of the ball supports 94 includes a flat supporting portion 96 formed with a U-shaped notch 96*a*, the U-shaped notch 96*a* having a gap smaller than the diameter of a ball 2, and ball receiving arms 98 formed in the flat supporting portion 96 by upwardly turning it at the forward edge. Thus, the U-shaped notch 96*a* in each of the flat supporting portion 96 can receive and support a ball 2. The side of the ball 2 can be supported by the ball receiving arms 98.

Each of the ball supports 94 will reliably prevent the ball 2 thereof from being damaged by any object such as guide rail or others during the conveyance, since the ball 2 is stably and firmly supported by the flat supporting portion 96 and ball receiving arms 98.

The function of the conveyor 90 for conveying the balls 2 will be described with reference to FIG. 8 which is a plan view illustrating the transfer of the balls from the guide rail 30*c* to the conveyor 90.

Figure 8:
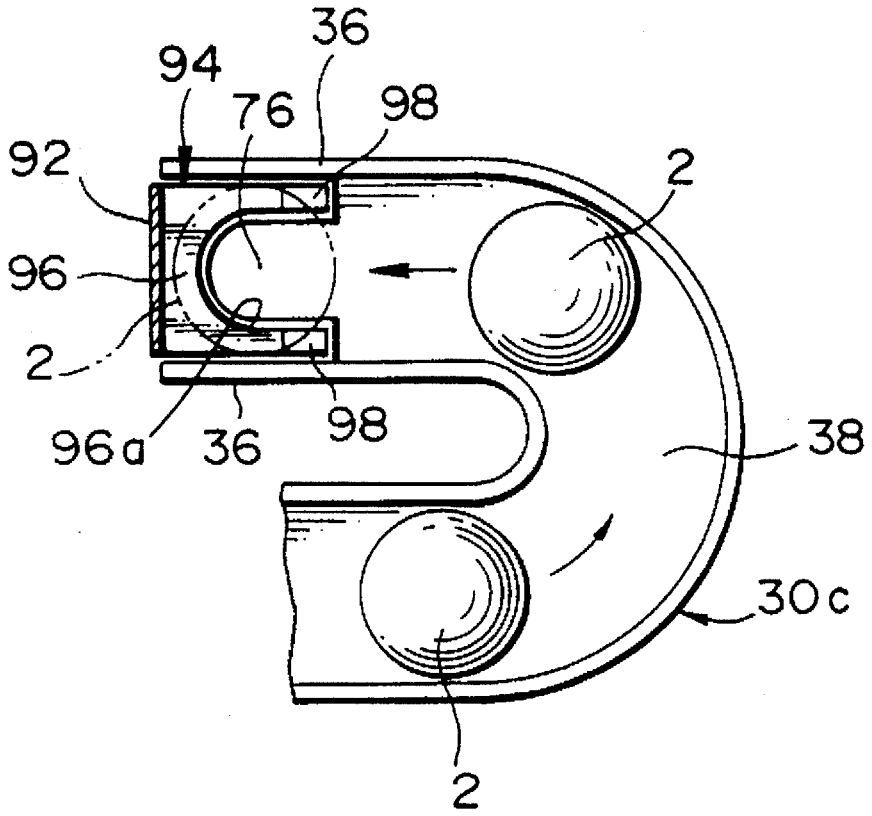
FIG. 8 is a plan view illustrating balls conveyed from the introduction rail to the conveyor.

Referring to FIG. 8, the guide rail 30*c* is turned from the storage rail 70 side to the conveyor 90 such that the balls 2 will be fed into a top surface of the upwardly moving run with the ball supports 94 in the conveyor belt 92. The tip end of the guide rail 30*c* is formed so that the ball supports 94 move between a pair of side walls 36. More particularly, the tip end of the guide rail 30*c* is defined only by the pair of side walls 36 without the bottom wall 38. The spacing between the side walls 36 is sufficient to permit the ball supports 94 to pass therethrough. The bottom wall 38 of the guide rail 30*c* has a protrusion 76 corresponding to the U-shaped notch 96*a* in the flat supporting portion of the ball support 94.

As a ball 2 moves along the guide rail 30*c* as shown in FIG. 8, the conveyor belt 92 engages the ball 2 to stop it. Under such a condition, the ball 2 is supported at the bottom thereof by the protrusion 76 and at the sides thereof by the side walls 36 of the guide rail 30*c*.

As the conveyor belt 92 moves upwards with the rotation of the upper and lower pulleys 91, 93, a ball support 94 also moves upwards from below the guide rail 30*c* to receive the ball 2 with the flat supporting portion 96 having the U-shaped notch 96*a* and the ball receiving arms 98. The ball 2 thus supported is upwardly conveyed by the conveyor belt 92 as it is further moved in the upward direction.

As shown in FIG. 2, the top of the conveyor belt 92 is connected to the guide rail 30*d*. More particularly, the top of the conveyor belt 92 is connected to the end port of the guide rail 30*d* at a position wherein the top of the conveyor belt 92 is located slightly above the bottom of the guide rail 30*d*.

In such a manner, the balls 2 conveyed by the conveyor means will be delivered to the guide rail 30*d*. The guide rail 30*d* is inclined to move and deliver the balls therealong. The forward end of the guide rail 30*d* has a downwardly directed guide pipe 24 for delivering the balls 2 downwards.

In this embodiment, the machine body 1 having the decorated housing 10 contains all the components aforementioned. If the conveyor 90 is removable, the machine body 1 can be moved more easily through the casters 12.

(Spiral Rail 100)

The spiral rail 100 will now be described. As shown in FIG. 1 or 2, this embodiment causes the balls 2 to roll along a spiral path which can be viewed by the players. For such a purpose, this embodiment includes the spiral rail 100 for causing the balls 2 to roll along the spiral path.

Figure 9:
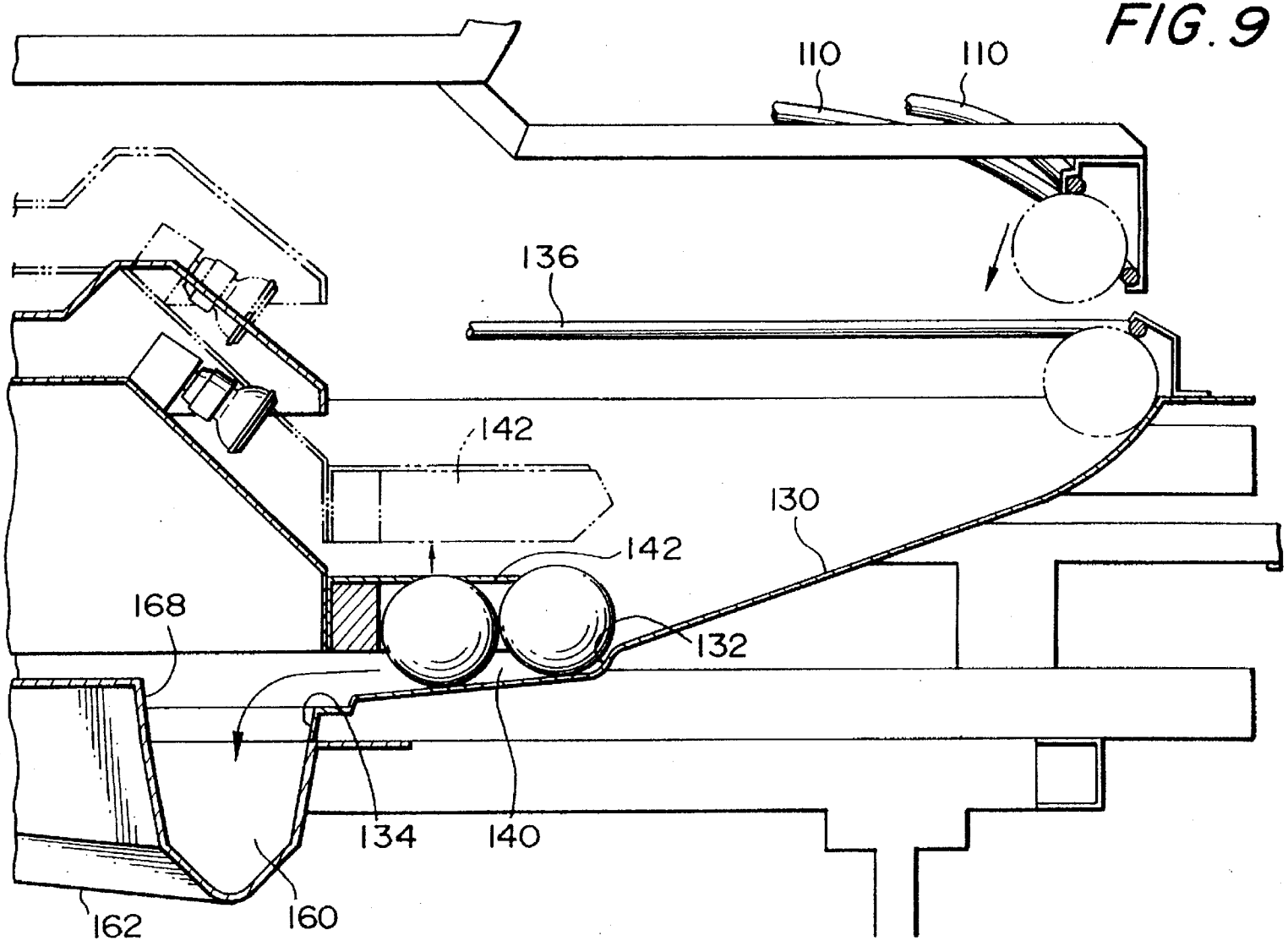
FIG. 9 is an enlarged view illustrating the field portion, the winning pocket portions and associated parts of FIG. 2.

The spiral rail 100 comprises a pair of spirally curved rails 110 each having a circular cross-section (see FIG. 9). The spacing between the curved rails 110 is smaller than at least the diameter of a ball 2 so as to support the ball at two points. It is preferred that the spacing is fixed so as to support the balls steadily at all times.

For causing the balls to roll along the spiral path, the sides of the balls 2 should be also supported so as to prevent the balls from falling off the spiral rail 100. For such a purpose, this embodiment causes the imaginary plane defined by the rails 110 to incline inwardly. In other words, the outer rail 110 is disposed to be somewhat higher than the inner rail 110. Thus, the outer rail 110 can support the outer side of the ball 2 so as to prevent the ball 2 from moving outward.

The relative position between the outer and inner rails 110 is preferably regulated against the outward movement of the balls 2. For example, The rails 110 may be located substantially horizontally in a position wherein a force causing the balls 2 to move outwards is smaller. In another position where such a force is larger, however, the outer rail 110 is preferably located substantially higher than the inner rail 110 to support the sides of the balls 2 with a sufficient force.

The force causing the balls 2 to move outwards increases toward the lower portion of the spiral rail 100. Eventually, the outer rail 110 becomes higher than the inner rail 110 toward the lower portion of the spiral rail 100. As the height of the outer rail 110 increases, the outer rail 110 is disposed directly above the inner rail 110. Finally, the outer rail 110 is located inside the inner rail 110 (see FIG. 9).

In such a manner, the balls 2 can be rolled towards the lower portion of the spiral rail 100.

The spiral rail 100 may be axially rotated. More particularly, the spiral rail 100 is supported by rail supports 112 at positions offset from the path of the balls 2, as shown in FIG. 2. The rail supports 112 are fixedly mounted on a rotary frame 114. The rotary frame 114 is formed by a square bar member bent into a hexagonal configuration and fixed to a rotary shaft 116 at the center thereof.

As shown in FIG. 2, the rotary shaft 116 is connected at the lower end to a drive 118 which axially rotates the rotary shaft 116. The rotation of the rotary shaft 116 rotates the rotary frame 114 mounted thereon, resulting in rotation of the spiral rail 100.

A support box 120 is fixedly mounted on the rotary shaft 116. The support box 120 fixedly supports an internal delivery pipe 122, the top of which is rotatably mounted on the lower end of the guide pipe 24. As the rotary shaft 116 is rotated, the support box 120 is also rotated to rotate the delivery pipe 122 fixed to the support box 120.

Since the delivery pipe 122 is curved to be disposed in a lateral direction, the balls 2 are laterally delivered from the guide pipe 24. As the rotary shaft 116 is rotated, the outlet 122*a* of the delivery pipe 122 is rotated 360 degrees.

The outlet 122*a* of the delivery pipe 122 axially rotated around the rotary shaft 116 is connected to the spiral rail 100. Since the spiral rail 100 also axially rotates around the rotary shaft 116, the rotation of the spiral rail 100 can deliver the balls 2.

Since the lower end of the spiral rail 100 is free end, the balls 2 conveyed from the delivery pipe 122 spirally rolls from the lower end of the spiral rail 100 while rotating around the rotary shaft 116. In addition to the spiral rolling of the balls 2, the spiral rail 100 guiding the balls 2 also rotates to provide a complicated motion to the balls 2. This increases a visual effect to the players.

(Field Portion 130)

The field portion 130 is located at the position to which the balls 2 are delivered. The field portion 130 will be described with reference to FIG. 9 or 10. FIG. 9 is an enlarged view illustrating the field portion 130, winning pocket portions 140 and associated parts in FIG. 2 while FIG. 10 is a plan view illustrating the field portion 130 with the winning pocket portions 140.

Figure 10:
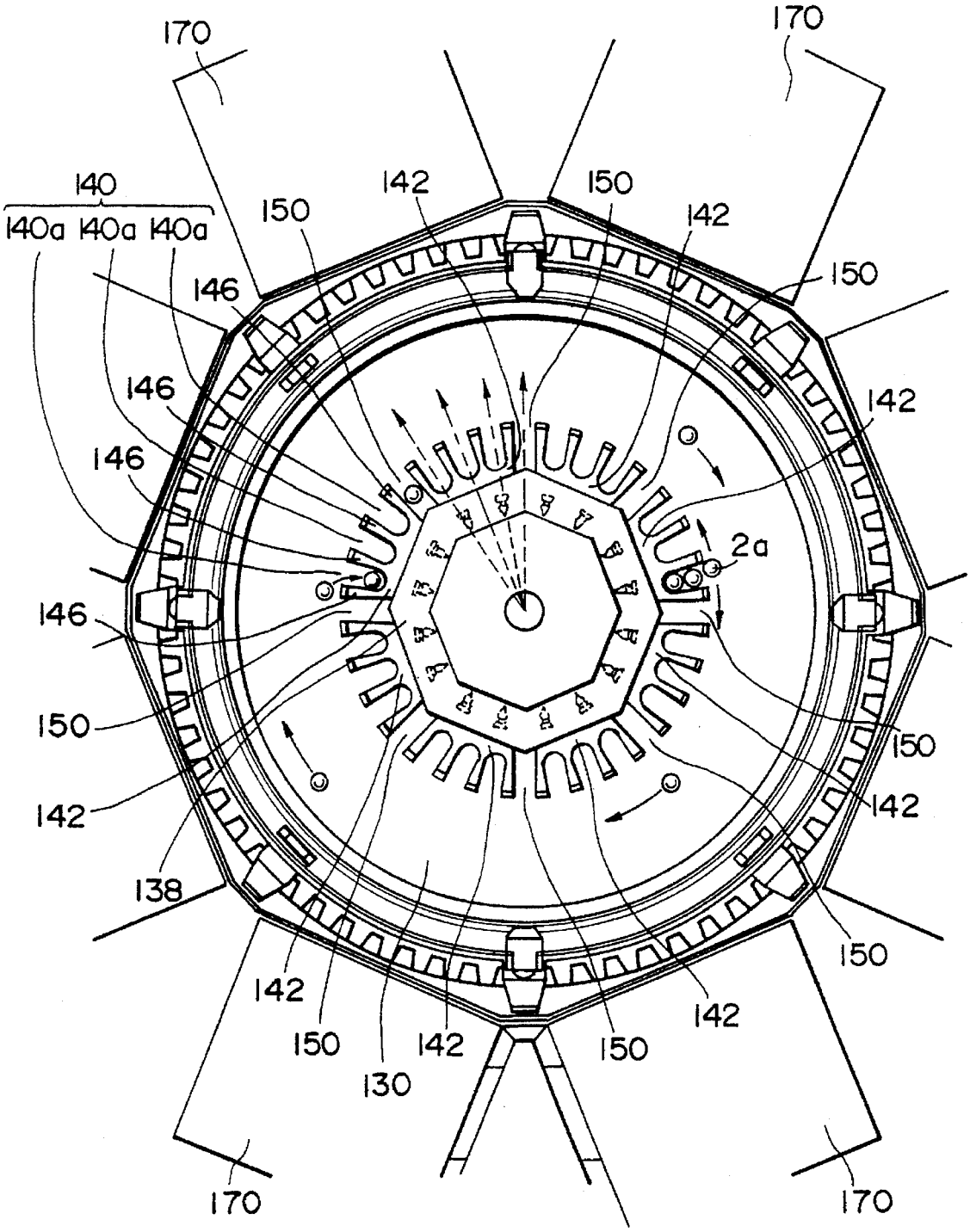
FIG. 10 is a plan view illustrating the field portion with the winning pocket portions.

The field portion 130 is of a circular configuration as shown in FIG. 10 and also in the form of a centrally recessed funnel as shown in FIG. 9. As the balls 2 roll on the field portion 130 in the circumferential direction, the balls 2 gradually roll circumferentially towards the center of the field portion 130.

A pocket step 132 is formed near the center of the field portion 130 at a position corresponding to the winning pocket portions 140. If the balls 2 move to areas lower than the pocket step 132, the balls 2 may be winning balls. Thus, the winning balls can clearly be distinguished from others.

The center of the field portion 130 also includes a collection opening 134 for collecting all the balls 2.

An outer peripheral guide rail 136 is formed on the outer periphery of the field portion 130 at an upper position somewhat more inwardly compared to the outer periphery thereof, as shown in FIG. 9. The outer peripheral guide rail 136 extends along the entire periphery of the field portion 130 so as to prevent any ball 2 discharged from the spiral rail 100 from failing off the field portion 130.

(Winning pocket portions 140 and Invalid Pockets 150)

Figure 11A:
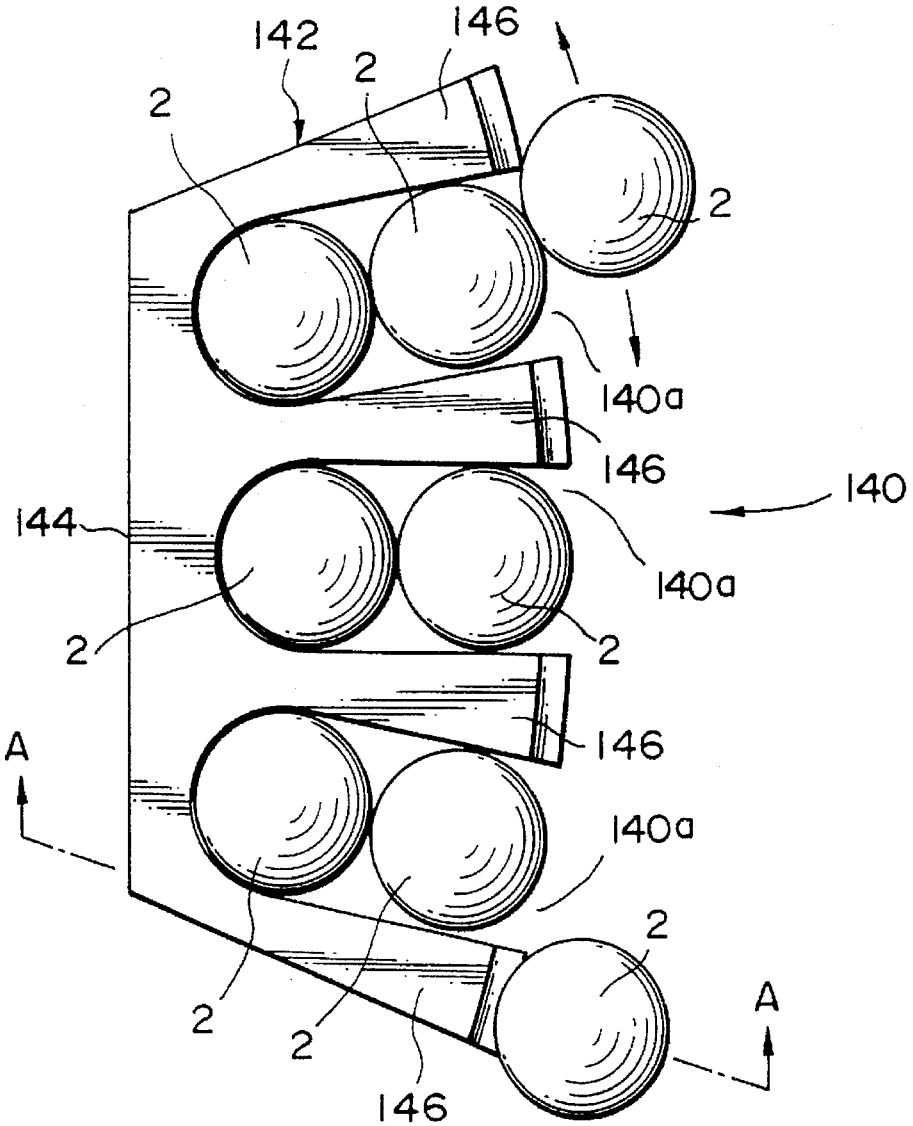
FIGS. 11A and 11B illustrate the winning pocket portion.
Figure 11B:
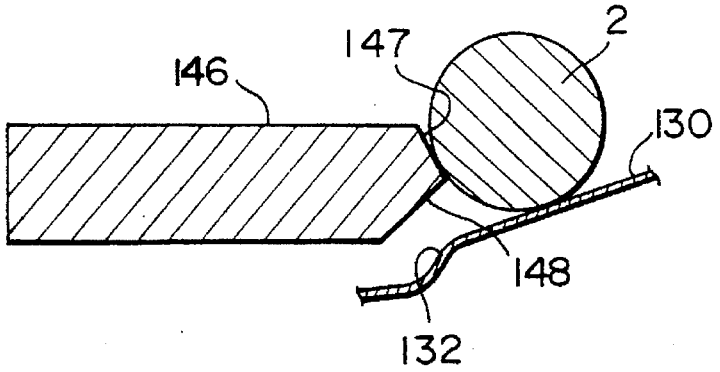

The winning pocket portions 140 and invalid pockets 150 will be described with reference to FIGS. 9 to 11A and 11B. FIG. 11A is a plan view illustrating the winning pocket portions 140 and FIG. 11B is a cross-sectional view taken along a line A—A in FIG. 11A.

As shown in FIG. 10, over the center area of the field portion 130, there is provided an octagon-shaped pocket mounting portion 138 having eight sides on each of which a pocket frame 142 is provided. The pocket frames 142 are mounted over the center of the field portion 130 to close the collection opening 134 thereof such that the balls 2 entering the winning pocket portions 140 does not move into the collection opening 134, as shown in FIG. 9.

Each of the pocket frames 142 is of substantially trapezoidal configuration as shown in FIG. 11A. The trapezoidal pocket frame 142 has an inner side 144 as a mounting surface which is mounted on the pocket mounting portion 138 and an outer side in which three pockets 140*a* constituting the winning pocket portion 140 are formed. More particularly, the three pockets 140*a* are separated from each other by dividing the outer side of the trapezoid into three sections through four partitions 146.

The partitions 146 are disposed to extend radially and outwardly from the center of the field portion 130 when the pocket frames 142 are mounted on the pocket mounting portion 138 as shown by two-dot chain line in FIG. 10. Thus, the winning pocket portions 140 are also disposed to extend radially and outwardly from the center of the field portion 130.

As shown in FIG. 11, each of the partitions 146 has a length substantially equal to the diameters of two balls. In other words, two balls 2 can enter one pocket 140*a*. At this point, the outer side of the second ball 2 is substantially flush with the outermost end of the partitions 146.

When two balls 2 are received in one pocket 140*a*, any ball 2 rolls toward that pocket 140*a* smoothly moves to any other pocket 140*a*. If the partitions 146 outwardly project beyond the second ball 2 received in a pocket 140*a*, a step will be formed between the second ball 2 and the partitions 146. Such a step may engage the other rolled ball 2 to stop it, resulting in a so-called dead ball. In this embodiment, however, such a dead ball will be less produced since the partitions 146 are flush with the outer sides of the second balls 2 within the pockets 140*a*, as described.

As shown in FIG. 119, each of the partitions 146 has a triangled tip. More particularly, the partition 146 includes upper and lower sloped end surfaces 147, 148 which form a given angle therebetween.

The upper sloped end surface 147 extends in a direction substantially perpendicular to the top surface of the field portion 130. Thus, a ball 2 engaged by the triangled tip of the partition 146 can be reliably shifted leftward or rightward, resulting in less dead balls. In other words, a ball 2 will not be held between the upper sloped end surface 147 and the top surface of the field portion 130. The upper sloped end surface 147 is located at a position spaced outwardly away from the pocket step 132 of the field portion 130. As a result, the ball 2 will not roll below the pocket sstep 132.

As shown in FIG. 11A, the upper sloped end surface 147 is also located to be flush with the outer side of the second ball 2 received in the pocket 140*a*. In other words, the length of each of the partitions 146 is equal to about two times the diameter of the ball 2. Thus, a smooth curvature is drawn by the upper sloped end face 147 which forms the outermost end of the partition 146 and the outer side of the second ball 2. This minimizes any step between the outermost end of the partition 146 and the second ball 2 received in the pocket 140*a* preventing dead balls.

The lower sloped end surface 148 of each of the partitions 146 is located at a position offset from the pocket step 132 of the field portion 130.

The invalid pockets 150 will be described. As shown in FIG. 10, the adjacent pocket frames 142 are spaced away from each other to form spacing equal to at least one ball. A ball 2 entering such spacing will not be held by the winning pocket portions 142. As a result, the ball 2 will roll into the collection opening 134 at all times. Such spacing forms an invalid pocket 150. Since the partitions 146 extend radially and outwardly from the center of the field portion 130, these invalid pockets 150 also extend radially and outwardly from the center of the field portion 130 (shown by two-dot chain line in FIG. 10).

As described, the above arrangement of the pocket frames. 142 is sufficient to lessen the dead balls, but does not completely eliminate them, In this embodiment, therefore, the pocket frames 142 are rocked to eliminate the dead balls.

As shown in FIG. 10, the pocket mounting portion 138 may be rocked from side to side around the central axis of the field portion 130 through a drive 118 (see FIG. 2). Thus, the pocket frames 142 mounted on the pocket mounting portion 138 are also rocked from side to side to direct the dead ball 2*a* (see FIG. 10) at the tip of the partition 146. This can completely avoid any dead ball.

It is preferred that the pocket frames 142 are rocked only when the presence of any ball 2 is sensed so as to eliminate dead balls.

An arrangement and function of sensing the balls 2 received in the winning pocket portions 140 and calculating the score will be described.

Such an arrangement comprises CCD cameras 60 disposed above the winning pocket portions 140, as shown in FIG. 2. Four such CCD cameras 60 may be provided for eight pocket frames 142 in the field portion 130, as shown in FIG. 10. More particularly, one CCD camera 60 senses balls 2 received in two adjacent pocket frames 142. Since a pocket frame 142 receives Six balls 2 as shown in FIG. 11, the adjacent pocket frames 142 receive twelve balls 2 in total. Therefore, a single CCD camera 60 senses twelve balls 2.

The CCD camera 60 not only views the interior of the winning pocket portions 140, but also observes areas adjacent to the inlets of the winning pocket portions 140. Thus, the CCD camera 60 can view all the areas where a dead ball may be produced.

The COD camera 60 senses image information in the foregoing areas to be sensed, the image information being then input into a ball determining unit (not shown).

The ball determining unit is responsive to the input image information to determine whether or not a ball 2 exists in the winning pocket portions 140. If a ball 2 is in any winning pocket portion 140, it is then determined of which color the ball 2 is and whether or not there is a dead ball 2*a*.

The balls are determined in the foregoing manner by obtaining the color component data of the sensed image at a preset observation point based on the above image information, and determining the color information at the above observation point based on the color component data.

More particularly, observation points are previously set at positions wherein twelve balls 2 may be disposed within the winning pocket portions 140 and at positions wherein a dead ball may be produced. The color information will be determined for every observation points.

The ball determining unit comprises an RGB decoder (not shown), an A/D converter, a frame buffer and a processing unit.

The image information input from the COD camera 60 is further input into the RGB decoder which in turn converts the foregoing image information into RGB data through a given converting process. The converted RGB data are further converted into digital data for R, G and B through the A/D converter. These digital data for R, G and B are stored in the frame buffer at R, G and B memories. The stored RGB data are read out by the processing unit to determine the colors at the respective observation points.

The as-determined colors are the ones viewed at the respective observation points and may be the colors of the balls 2 or of the field portion 130. The processing unit previously stores the colors of the balls 2 to be used as well as the color of the field portion 130. The processing unit compares the as-determined colors with the previously stored colors to determine whether or not a ball 2 exists.

It is now assumed that balls 2 to be used are in four colors which are red, blue, yellow and gold, and that the color of the field portion 130 is white. If the color determined in a winning pocket portion 140 at an observation point is white, the white color indicates the field portion 130. This means that there is no ball 2. If the color determined in a winning pocket portion 140 at an observation point is red, it will be determined that a red ball 2 is received in that winning pocket portion 140.

If the color determined at an observation point near the inlet of a winning pocket portion 140 is white, this means that there is no ball 2. In other words, there is no dead ball. If the color determined at another observation point near the inlet of the winning pocket portion 140 is any color other than white (or any of the red, blue, yellow and gold colors), this means that any ball 2 exists therein. That is, there is a dead ball.

By determining whether or not a ball 2 exists in a winning pocket portion 140 and of what color that ball 2 is, the score is calculated according to a predetermined game rule. If it is determined that a dead ball exists, the pocket frames 142 will be rocked from side to side to eliminate such a dead ball.

On termination of the game, all the balls 2 in the winning pocket portions 140 should be collected. In this embodiment, the pocket frames 142 may be lifted to release the balls 2 which are then conveyed to the collection opening 134 in the field portion 130.

This will be described in more detail with reference to FIG. 9. In this figure, the pocket frame 142 shown by a solid line holds balls 2. When the game terminates, this pocket frame 142 may be lifted to a position shown by an imaginary line (two-dot chain line) by the drive 118 (see FIG. 2). Thus, the balls 2 are released and roll into the collection opening 134. (Spiral Collection Rail 160)

The collection opening 134 is connected to a spiral collection rail 160 as shown in FIG. 9. The spiral collection rail 160 is formed in a collector body 162 which is located at the center of the field portion 130, as shown in FIG. 2.

Figure 12A:
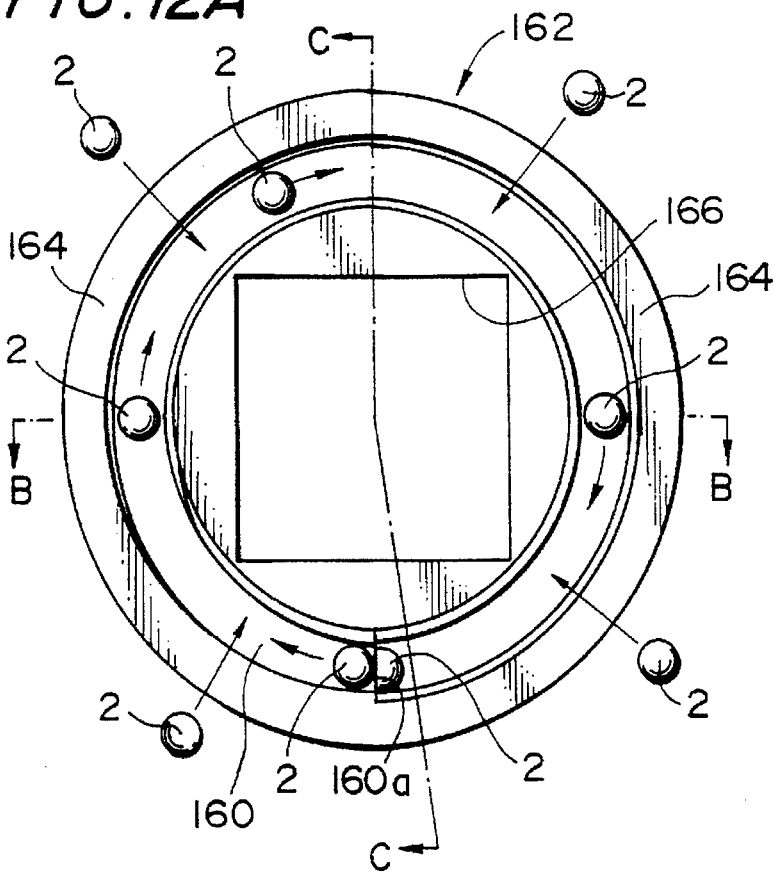
FIGS. 12A to 12D illustrate the main body of a collector.
Figure 12D:
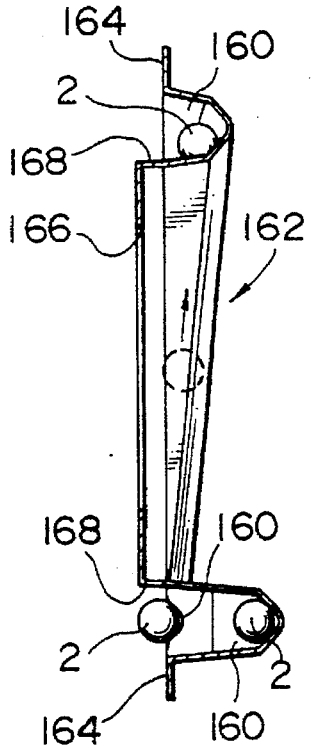
Figure 12B:
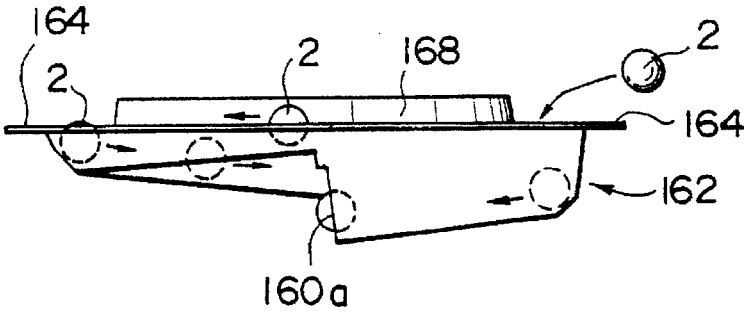
Figure 12C:
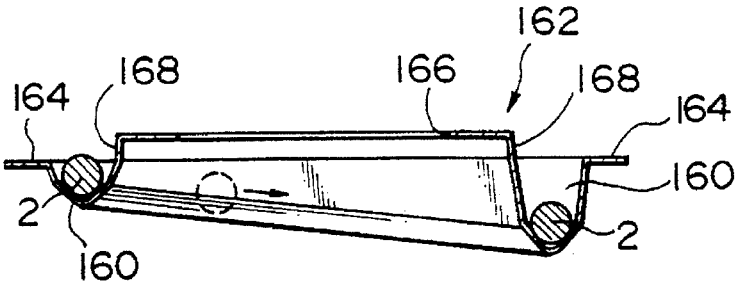

FIGS. 12A to 12*d* show the collector body 162. FIG. 12A is a plan view; FIG. 12B a front view; FIG. 12C a cross-sectional view taken along a line B—B in FIG. 12A; and FIG. 12D is a cross-sectional view taken along a line C—C in FIG. 12A.

As shown, the collector body 162 includes a circumferentially extending flange 164 formed therein at the outer periphery thereof. The flange 164 may include bolt receiving holes (not shown) formed therethrough so that the flame 164 may be mounted on the machine body 1. The collector body 162 also includes a central opening 166 of square configuration which is adapted to receive the drive 118 (see FIG. 2).

An annular raised portion 168 is formed in the collector body 162 opposite to the flange 164. The spiral collection rail 160 is formed between the annular raised portion 168 and the flange 164. More particularly, as shown in FIGS. 12C and 12D, the spiral collection rail 160 curves downward from the flange 164 to form a trough-like groove for guiding the balls 2.

The spiral collection rail 160 gradually slopes downwards as shown by arrow in FIG. 12A. The balls 2 will spirally roll in the spiral collection rail 160 from the top to the bottom position at which the balls 2 are discharged through the outlet 160*a*. The outlet 160*a* is located directly below the top of the spiral collection rail 160. Namely, the spiral collection rail 160 depicts a circle so that all the balls rolling from every points of the spiral collection rail 160 will be completely received therein (see FIG. 12A).

The spiral collection rail 160 provides the following effects. As shown in FIG. 9, the balls 2 rolling from the collection opening 134 are received by the spiral collection rail 160.

Since the field portion 130 is of a circular funnel-shaped configuration, the balls 2 will roll from all directions. However, the spiral collection rail 160 can receive all the balls 2 rolling from all directions. Since the spiral collection rail 160 has the inner raised portion 168, the inner raised portion 168 stops and shifts the balls 2 rolling thereto toward the spiral collection rail 160.

The balls 2 conveyed to the spiral collection rail 160 will be arranged in a circumferential line. Since the spiral collection rail 160 receives the balls 2 arranged in a circumferential line, the balls 2 can be conveyed and delivered without jamming.

Since the winning pocket portions 140 are formed to extend in a radial and outward direction as shown in FIG. 10, many balls 2 roll into the collection opening 134 at once from all directions when they are to be collected from the winning pocket portions 140. In this embodiment, it is required that the balls 2 are arranged in a line for distinguishing the balls 2 one at a time with respect to the colors or the like.

If the balls 2 are once received by any other means such as a hopper or the like, the balls 2 may jam when they are delivered one at a time in a line. However, the spiral collection rail 160 can arrange the balls 2 in a line immediately when they enter the spiral collection rail 160. Thus, any jamming can be avoided and the balls 2 can be delivered smoothly one at a time.

The collected balls 2 are conveyed via the spiral collection rail 160 to the outlet 160*a* where they are delivered to the guide rail 30*a* through the guide rods 22 (see FIGS. 2 and 3).

(Play Stations 170)

The play stations 170 arranged around the machine body 1 will be described with reference to FIGS. 1 and 10. In FIG. 10, eight pocket frames 142 are provided to form eight of winning pocket portions 140. A player may select one of these winning pocket portions 140. This is accomplished by selecting one of eight play stations 170 which are disposed corresponding to the respective pocket frames 142. A dead space between two adjacent play stations 170 is filled with an intermediate station 172 (see FIG. 1).

As shown in FIG. 1, each of the play stations 170 comprises a display screen 180, control buttons 174, a pay-back button 176, a coin slot 178 and a coin return port 179. The control buttons 174 are used to select a bet according to the contents of the game. The display screen 180 can display the types of bets, the number of coins inserted into the coin slot 178 and/or the number of coins to be returned.

The details of the contents displayed on the display screen 180 will be described with reference to FIG. 13 which is a schematic view illustrating the control panel of a play station 170 including the display screen 180.

Prior to description of the contents displayed on the display screen 180, the contents of a game will be described briefly. In this game 16 balls are used and the more balls enter the winning pocket portions 140 the higher the score is. Basically the balls used in the game are of three colors which are red, blue and yellow. The number of balls is different for each color. In addition, a gold ball is randomly dispensed one per several game stages. The gold ball is a bonus ball providing a special bonus point. Since the number of balls is different for each color, the probability of the balls entering the winning pocket portions 140 is also different for each color. Thus, it is possible to bet on each color. Additional bonus point may be obtained depending on how the balls in the winning pocket portions 140 are lined.

Figure 13:
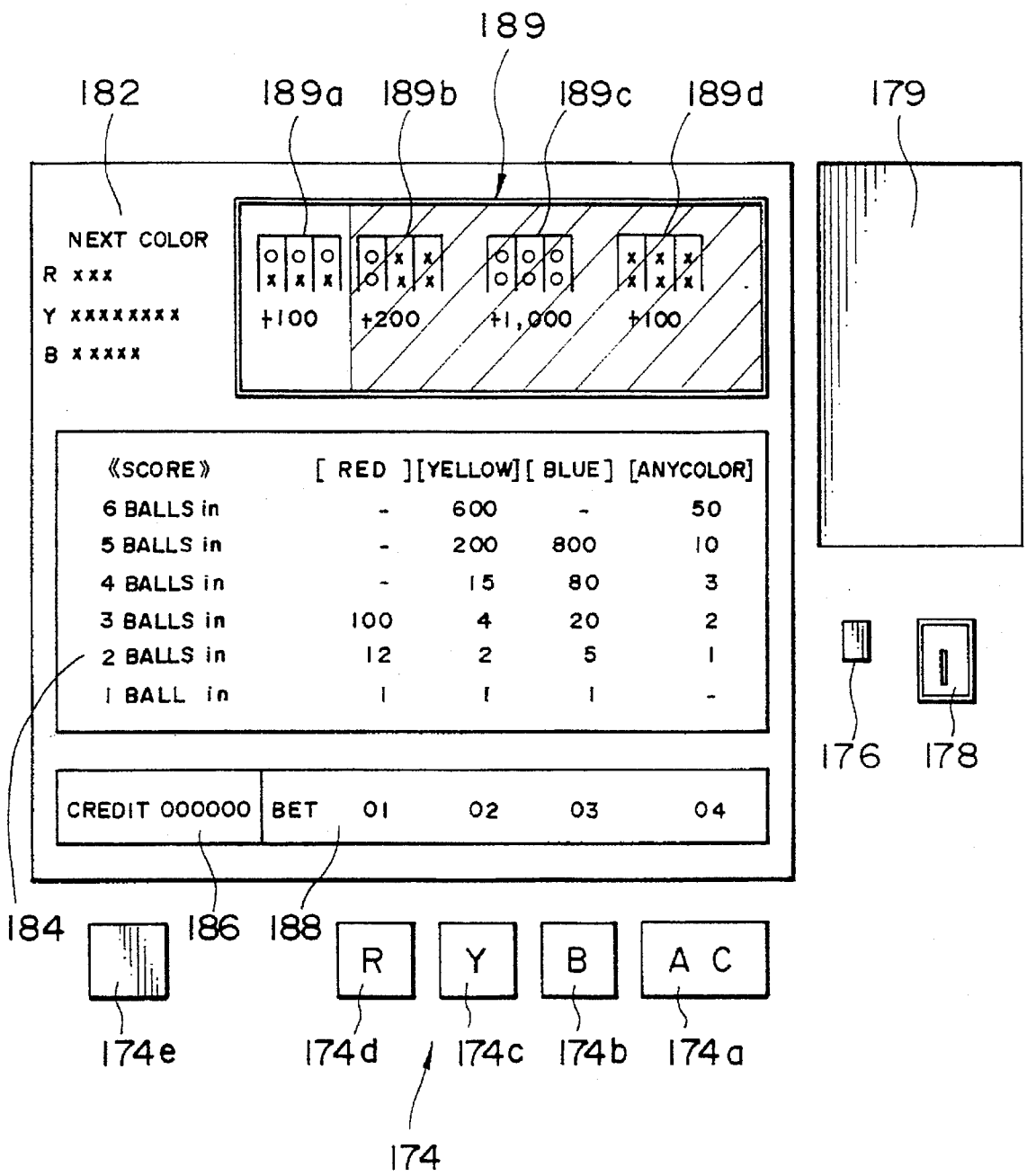
FIG. 13 is a schematic view illustrating the control panel of a play station including a display screen.

Referring to FIG. 13, the display screen 180 has a ball number indicator 182 for indicating the proportion of the different types of balls. The ball number indicator 182 indicates the number of balls for each color in the next game stage. In FIG. 13, for example, the ball number indicator 182 shows that the next game stage will use three red balls, eight yellow balls and five blue balls.

Below the ball number indicator 182, there is provided a betting rate indicator 184 for indicating a betting rate for each color. More particularly, the number of balls having entered the winning pocket portions 140, the betting rates for red balls, yellow balls, blue balls and all the balls irrespective of color are shown in the order starting from the left side as viewed in FIG. 13.

In place of the betting rates, the number of coins to be returned to a winner, the number of batted coins times the betting rate may be indicated.

The number of balls in the leftwardmost column ranges between one and six. Balls equal to or more than seven are not indicated because winning pocket portion 140 in a pocket frame 142 is designed to receive no more than six balls as shown in FIG. 10.

For example, the betting rates are 1, 12 and 100 when one, two and three red balls enter the winning pocket portions 140, respectively. Balls equal to or more than four are not indicated because only three red balls are used as indicated by the ball number indicator 182. For the same reason, as for blue balls the betting rates for up to five balls are indicated.

With the betting rate for all the balls irrespective of color, it is one for two balls, two for three balls, three for four balls, ten for five balls and fifty for six balls. If only one ball enters a winning pocket portion 140, since this is substantially high in probability. A player will lose all the coins.

The lowermost stage of the display screen 180 has a credit indicator 186 and a betted coins indicator 188.

The credit indicator 186 shows the number of coins inserted in the coin slot 178 and the total number of coins to be returned to the winner. The number of betted coins is subtracted from the number of coins to be returned, with the result being displayed on the credit indicator 186.

For example, the credit indicator 186 of FIG. 13 shows zero since all the inserted coins are betted.

The betted coins indicator 188 shows how many coins are betted for each object. As described, in the game it is possible to bet how many balls for each color enter the winning pocket portion 140 or how many balls irrespective of the colors enter the winning pocket portion 140. The player can recognize an object to bet on and the number of betted coins through the betted coins indicator 188.

For example, FIG. 13 shows the fact that one coin is betted on red balls, two coins on yellow balls, three on blue balls and four on the balls irrespective of color.

A bonus chance indicator 189 is provided in the uppermost area of the display screen 180 on the right side of the ball number indicator 182. The bonus chance indicator 189 indicates the score obtained under other conditions besides the betting.

For example, the bonus chance indicator 189 of FIG. 13 has four ball arrangement portions 189*a* to 189*d* which provide four types of bonus chances. The ball arrangement portions 189*a* to 189*d* show different arrangements of balls having entered the winning pocket portions 140.

More particularly, as shown in FIG. 11A, three pockets 140*a* providing a winning pocket portion 140 are formed in one pocket frame 143. The ball arrangement portions 189*a* to 189*d* indicate the different patterns of balls having entered the winning pocket portion 140.

In the bonus chance indicator 189 of FIG. 13, the leftward ball arrangement portion 189*a* shows that each of all the three pockets 140*a* receives one ball under which +100 is indicated. Such an indication means that 100 is added to the betting rate, if the balls received by each of the pockets 140*a* one after another make a line in a transverse direction.

The indication of +100 may mean that additional one hundred coins are to be returned to the winner.

If it is assumed that all the blue balls enter the winning pocket portion 140 with the pattern shown by the ball arrangement pattern 189*a* when three coins are betted on blue balls, the total reimburse rate multiplied by 20 with an addition of 100 to provide a magnification of×120. Since three coins are betted on blue balls, 360 coins given by 3 times 120 will eventually be paid back to the winner.

Similarly, the ball arrangement portion 189*b* shows that only two balls enter a pocket 140*a*; the ball arrangement portion 189*c* shows that two balls enter each of all the pockets 140*a*; and the ball arrangement portion 189*d* shows that no ball enters the pockets 140*a*. In these cases, a bonus point will be added to the score.

The conditions under which the bonus point is given are not limited to the foregoing. The bonus point may be added when only the balls of the same color are received in the winning pocket portion 140 or when a ball of a desired color enters a predetermined portion.

The bonus chance may be effective only under a given condition. The effective bonus chance may be lighted while the other invalid bonus chances may be displayed dark. For example, FIG. 13 shows that only the ball arrangement portion 189*a* is lighted to indicate the effectiveness of the bonus chance, while other ball arrangement portions 189*b* to 189*d* are displayed dark to indicate the ineffectiveness of the bonus chances.

To determine whether or not the bonus chance is effective, it is preferred that there is provided a control unit for determining randomly the effectiveness of the bonus chance each time medal is inserted. Thus, the player cannot know when the bonus chance becomes effective. Each time a coin is inserted, a player may enjoy a kind of betting for determining whether or not the bonus chance becomes effective.

The display screen 180 displays the foregoing content, and control buttons 174 are located below the display screen 180.

More particularly, FIG. 13 shows from the right side an all color button 174*a* used to bet on any color, a blue ball button 174*b* for betting on blue balls, a yellow ball button 174*c* for betting on yellow balls and a red ball button 174*d* for betting on red balls.

When one of these control buttons 174*a* to 174*d* is pressed, one coin is betted for the corresponding betting. For example, the betted coin indicator 188 indicates that the blue ball button 174*b* has been pressed three times since three coins are bet on blue ball.

A multi-bet button 174*e* is located on the left side of the red ball button 174*d*. The multi-bet button 174*e* may be illuminated on when it is pressed and if the number of coins displayed in the credit indicator 186 exceeds ten. Each time any of the other control buttons 174*a* to 174*d* is pressed while the multi-bet button 174*e* is illuminated, 10 coins can be betted. When the multi-bet button 174*e* is again pressed, it is turned off to release the 10-coin betting mode. Each time any of the other control buttons 174*a* to 174*d* is pressed, a single coin may be betted.

A coin pay-back port 179 is located on the right side of the display screen 180. The coin return port 179 is in the form of a dish for receiving the returning coins indicated by the credit indicator 186. When the pay-back button 176 is pressed, the coins are returned to the winner.

Only when there is a credit, the pay-back button 176 is illuminated. When it is once pressed, the pay-back button 176 flashes to initiate to pay the coins back to the winner. Although the coins may be returned at any time, a predetermined number of coins may be returned at a time. Pressing again the pay-back button 176 during the pay-back mode, may interrupt the mode.

A coin slot 179 is located on the right side of the pay-back button 176. The player can insert a desired number of coins into the machine.

(Contents of Game)

A game played by the ball game apparatus described in connection with the aforementioned embodiment of the present invention will be described.

Since the ball game apparatus includes eight play stations 170 as described, the player can select one of the eight play stations 170. Since the respective pocket frames 142 are provided in each of the play stations 170, a particular winning pocket portion 140 will be determined eventually (see FIG. 10).

When the play station 170 is selected, its display screen 180 displays various information.

The ball number indicator 182 indicates how many balls are to be used for each of the red, yellow and blue colors. In FIG. 13, for example, the ball number indicator 182 indicates that three red balls, eight yellow balls and five blue balls are used.

Since the number of balls is different for each color, the probability of the balls for each color entering the winning pocket portion 140 is also different for each color. The betting rate indicator 184 indicates the betting rates different for the number of each colored balls. For example, it may indicate that when one blue ball enters a winning pocket portion 140, the betting rate is one; when two blue balls enter the winning pocket portion 140, the betting rate is five; when three blue balls enter the winning pocket portion 140, the betting rate is twenty; and so on.

The player will bet coins with reference to these indicated betting rates. For such a purpose, a given number of coins has been credited by inserting them in the coin slot 178. Thus, the number of coins inserted is indicated at the credit indicator 186 (see FIG. 13).

If some coins are inserted into the machine, any of the ball arrangement, portions 189*a* to 189*d* which are initially displayed dark, is illuminated to indicate that the bonus chance is now effective. However, the player does not know when this bonus chance becomes effective since it is determined at random.

In such a manner, the betting terminates. For example, one coin is betted on red balls; two coins are betted on yellow balls; three coins are betted on blue balls and four coins are betted for the balls irrespective of color, as shown in FIG. 13. The ball arrangement portion 189*a* is illuminated on to indicate the addition of bonus point if the balls are arranged in a transverse line.

The player does the betting by operating the control buttons 174 within a predetermined time. During such a time, a slow-tempo BGM may be performed. When the time is about to be up, another BGM may be performed.

Each of the control buttons 174*a* to 174*d* can perform the betting for a color indicated directly above the control button. For example, the control button 174*a* may be used to a bet from which the coins will be returned if two or more balls enter the winning pocket portion 140 irrespectively of the color. Alternatively, the control button 174*b* may be used to a bet from which coins will be returned if one or more blue balls enter the winning pocket portion 140.

When the betting is completed, the game starts. More particularly, the predetermined number of balls 2 for each color are delivered from the storage rail 70 shown in FIG. 3. As shown in FIG. 2, the balls 2 are conveyed to the spiral rail 100 through the guide rails 30, conveyer 90, guide pipe 24 and delivery pipe 122. The conveyed balls 2 roll via the spiral rail 100 to the field portion 130, as shown in FIG. 1.

Since the field portion 130 is of the funnel-shaped configuration, the conveyed balls 2 gradually roll toward the center of the field portion 130, while rotating in a circumferential direction as shown in FIG. 10. The balls 2 will enter the winning pocket portion 140 or invalid pocket 150.

As the balls 2 enter the winning pocket portion 140, the CCD camera 60 located above the winning pocket portion 140 senses and outputs them toward the calculator means. The calculator means calculates the color and number of balls 2 from the input signals, and stores them in the calculator means.

In this embodiment, a gold ball 2 may be delivered one per several games after all the balls 2 have been delivered. This gold ball 2 provides twice the betting rate when it enters a winning pocket portion 140. The gold ball 2 can be sensed by the CCD camera 60. The gold ball 2 can increase the score points by one even if the betting are performed for any colored ball.

Even when such betting as shown in FIG. 13 is performed and if a single red ball and a gold ball enter a winning pocket portion 140, the gold ball is counted as red ball. And that makes the number of red balls two. Furthermore, the betting rate is multiplied by two. The number of red balls increase by twelve times and also two times to provide the total betting rate of 24 times.

When all the balls enter the winning pocket portion 140 or invalid pocket 150, the game terminates.

The calculator means then compares the number, color and arrangement of balls having entered the winning pocket portion 140 with the betting rates set by the player through the control buttons 174. If the player wins, the coins are returned. More particularly, the credit indicator 186 stores the number of coins to be returned. When the player presses the pay-back button 176, the coins are paid back to the player.

During or after the return of the coins, the balls 2 are collected through the collection opening 134 of the field portion 130. This operation has been described hereinbefore.

The game can be repeated by the players.

The present invention is not limited to the aforementioned embodiments, but may be carried out in any of various modified or changed forms. For example, the ball game apparatus can be simply used to compete the score points. Alternatively, the ball game apparatus can be used for a single-player game.

Further, the ball game apparatus can be used to add score points only when balls of a particular color enters the corresponding winning pocket portion. Alternatively, score points may not be added even when balls of a particular color enters the corresponding winning pockets.

We claim:

1. A ball game apparatus for using balls to score points, comprising:

a plurality of balls;

a ball delivery unit for automatically delivering said balls;

a field portion on which delivered balls roll with a predetermined degree of freedom;

a plurality of winning pocket portions formed on said field portion for receiving said balls;

sensor means for counting the number of balls received by said winning pocket portions;

calculator means for calculating a score according to the number of balls counted by said sensor means;

a coin slot, a coin outlet and an operation unit, wherein said operation unit is formed such that a number of bet coins can be set, said calculator means being operative for determining a number of coins to be paid back according to the number of bet coins and said score; and wherein a player can select one of said winning pocket portions, given points being scored as said balls enter a selected winning pocket portion.

2. A ball game apparatus as defined in claim 1, further comprising at least one invalid pocket formed on said field portion wherein said balls make no score when said balls enter said at least one invalid pocket.

3. A ball game apparatus as defined in claim 2, wherein said ball delivery unit further comprises an ejector for giving an initial speed to said balls, and wherein said winning pocket portions are formed on a center area of said field portion which is of circular funnel-shaped configuration, said ejector being operative for sending said balls to said field portion such that said balls roll on said field portion, gradually fall toward the center area of said field portion and finally may enter said winning pocket portions or said at least one invalid pocket.

4. A ball game apparatus as defined in claim 3, wherein said balls are distinguishable balls comprising at least two groups which can be visually distinguished from each other by a player, and wherein as said player selects one or more groups of said distinguishable balls, said sensor means counts the number of said distinguishable balls of selected groups which have entered said winning pocket portions.

5. A ball game apparatus as defined in claim 2, wherein said balls are distinguishable balls comprising at least two groups which can be visually distinguished from each other by a player, and wherein as said player selects one or more groups of said distinguishable balls, said sensor means counts the number of said distinguishable balls of selected groups which have entered said winning pocket portions.

6. A ball game apparatus as defined in claim 5 wherein a plurality of winning pocket portions are formed and wherein said player can select one of said winning pocket portions, given points being scored as said distinguishable balls of selected groups enter a selected winning pocket portion.

7. A ball game apparatus as defined in claim 5, further comprising a plurality of said operation units through which a plurality of players can simultaneously enjoy a game and wherein each of said winning pocket portions is previously determined to correspond to one of said operation units, and a player can select one of said winning pocket portions by selecting one of said operation units, given points being scored as said distinguishable balls of said selected groups enter a selected winning pocket portion.

8. A ball game apparatus as defined in claim 7 wherein said ball delivery unit includes a guide rail which spirally extends in a vertical direction, and wherein said winning pocket portions are formed over a center area of said field portion which is of circular funnel-shaped configuration, and wherein said balls roll down on said guide rail and are delivered to said field portion while being accelerated, said balls then rolling on said field portion in a circumferential direction and gradually falling toward the center area of said field portion, and finally said balls being allowed to enter said winning pocket portions, a plurality of said operation units being disposed around said field portion so that all the players can operate their operation units while facing said field portion, said guide rail being formed such that at least a part of entire shape of said balls can be seen from the direction of said operation units while said balls are guided on said guide rail, said selected winning pocket portion being arranged exposed to corresponding operation unit, whereby said players can observe said balls as they spirally roll on said guide rail, are delivered to said field portion and enter said selected winning pocket portion.

9. A ball game apparatus as defined in claim 8, further comprising ball lifting means for lifting and conveying said balls from a position lower than said field portion to the top of said guide rail and an introduction rail for introducing said balls into said ball lifting means, said winning pocket portions being formed to hold said balls on said field portion, wherein said field portion includes a collection opening formed therein at a position nearer the center of said field portion than said winning pocket portions, said winning pocket portions and field portion being movable relative to each other to release said balls from said winning pocket portions, said collection opening being connected to said ball lifting means through said introduction rail such that said balls can be introduced into said ball lifting means, whereby when said balls are released through relative movement between said winning pocket portions and said field portion, said balls roll on said field portion and fall onto said introduction rail through said collection opening, said balls then being introduced into said ball lifting means and being lifted to said top of said guide rail, said balls spirally rolling on said guide rail and fall onto said field portion.

10. A ball game apparatus as defined in claim 5 wherein said winning pocket portions include a plurality of pockets which respectively receive a plurality of said distinguishable balls and have a configuration such that said player can tell the number of received distinguishable balls in each of said pockets, and wherein said sensor means counts the number of said received distinguishable balls in each of said pockets, and wherein said calculation means calculates and scores points from the number of said received distinguishable balls according to a predetermined rule.

11. A ball game apparatus as defined in claim 10, wherein said player can select one of said winning pocket portions, given points being scored as said distinguishable balls enter a selected winning pocket portion.

12. A ball game apparatus as defined in claim 10 wherein said winning pocket portions are formed to have a configuration such that said player can tell a group of said received distinguishable balls in each of said pockets, and wherein said sensor means distinguishes a group of said received distinguishable balls from each other in each of said pockets, and wherein said calculation means calculates and scores points from the number and group of said received distinguishable balls according to a predetermined rule.

13. A ball game apparatus as defined in claim 12 wherein a plurality of said winning pocket portions are formed and wherein said player can select one of said winning pocket portions, given points being scored as said distinguishable balls enter a selected winning pocket portion.

14. A ball game apparatus as defined in claim 2 wherein a plurality of winning pocket portions are formed and wherein a player can select one of said winning pocket portions, given points being scored as said balls enter a selected winning pocket portion.

15. A ball game apparatus as defined in claim 1, wherein said balls are distinguishable balls comprising at least two groups which can be visually distinguished from each other by a player, and wherein as said player selects one or more groups of said distinguishable balls, said sensor means counts the number of said distinguishable balls of selected groups which has entered said winning pocket portions.

16. A ball game apparatus for using balls to score points, comprising:

a plurality of balls;

a ball delivery unit for automatically delivering said balls;

a field portion on which delivered balls roll with a predetermined degree of freedom;

a plurality of winning pocket portions formed on said field portion for receiving said balls;

sensor means for counting the number of balls received by said winning pocket portions; and calculator means for calculating a score according to the number of balls counted by said sensor means, wherein said ball delivery unit further comprises an ejector for giving an initial speed to said balls, and wherein said winning pocket portions are formed on a center area of said field portion which is of circular funnel-shaped configuration, said ejector being operative for sending said balls to said field portion such that said balls roll on said field portion, gradually fall toward the center area of said field portion and finally may enter said winning pocket portions.

17. A ball game apparatus as defined in claim 16 wherein said ball delivery unit includes a guide rail which spirally extends in a vertical direction, and wherein said balls roll down on said guide rail and are delivered to said field portion while being accelerated, said balls then rolling on said field portion in the circumferential direction and gradually falling toward center area of said field portion, and finally said balls being allowed to enter said winning pocket portions.

18. A ball game apparatus as defined in claim 17, further comprising ball lifting means for lifting and conveying said balls from a position lower than said field portion to the top of said guide rail and an introduction rail for introducing said balls into said ball lifting means, said winning pocket portions being formed to hold said balls on said field portion, wherein said field portion includes a collection opening formed therein at a position nearer the center of said field portion than said winning pocket portions, said winning pocket portions and field portion being movable relative to each other to release said balls from said winning pocket portions, said collection opening being connected to said ball lifting means through said introduction rail such that said balls can be introduced into said ball lifting means, whereby when said balls are released through relative movement between said winning pocket portions and said field portion, said balls roll on said field portion and fall onto said introduction rail through said collection opening, said balls then being introduced into said ball lifting means and being lifted to said top of said guide rail, said balls spirally rolling on said guide rail and fall onto said field portion.

19. A ball game apparatus as defined in claim 18, further comprising ball storing means for temporarily storing said balls collected from said field portion and for delivering stored balls to said ball delivery unit after a predetermined time period.

20. A ball game apparatus as defined in claim 19, wherein said balls are distinguishable balls comprising at least two groups which can be visually distinguished from each other by a player, and wherein said ball storing means includes distinguishing means for distinguishing said distinguishable balls, sorting means for sorting distinguished balls, and number setting means for setting the number of distinguishable balls to be used for each group in a game, whereby according to the number of distinguishable balls set by said number setting means, said ball storing means delivers stored balls into said ball delivery unit while sorting them into different groups.

21. A ball game apparatus for using balls to score points, comprising:

a plurality of balls;

a ball delivery unit for automatically delivering said balls;

a field portion on which delivered balls roll with a predetermined degree of freedom;

a plurality of winning pocket portions formed on said field portion for receiving said balls;

sensor means for counting the number of balls received by said winning pocket portions;

calculator means for calculating a score according to the number of balls counted by said sensor means; and a coin slot, a coin outlet and a plurality of operation units, wherein said operation units are formed such that a number of bet coins can be set, said calculator means being operative for determining a number of coins to be paid back according to the number of bet coins and said score, wherein said plurality of operation units allow a plurality of players to simultaneously enjoy a game.

22. A ball game apparatus as defined in claim 21, wherein each of said winning pocket portions is previously determined to correspond to one of said operation units, and a player can select one of said winning pocket portions by selecting one of said operation units, and wherein given points are scored as said balls enter a selected winning pocket portion.

23. A ball game apparatus for using balls to score points, comprising:

a plurality of balls;

a ball delivery unit for automatically and simultaneously delivering a plurality of said balls onto a field portion on which the delivered balls simultaneously roll with a predetermined degree of freedom;

at least one selectively designatable winning pocket and invalid pocket portion formed on said field portion for receiving said balls;

sensor means for counting the number of balls received by said selectively designatable winning pocket portion; and calculator means for calculating a score according to the number of balls counted by said sensor means.

* * * * *